US007201147B2

(12) United States Patent
Bernhardt et al.

(10) Patent No.: US 7,201,147 B2
(45) Date of Patent: Apr. 10, 2007

(54) CONTROL STRATEGIES FOR A VARIABLE DISPLACEMENT OIL PUMP

(75) Inventors: John E. Bernhardt, Evergreen Park, IL (US); Christopher R. Ciesla, Palos Heights, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 326 days.

(21) Appl. No.: 10/217,634

(22) Filed: Aug. 13, 2002

(65) Prior Publication Data

US 2004/0031467 A1 Feb. 19, 2004

(51) Int. Cl.
*F02M 37/04* (2006.01)

(52) U.S. Cl. ..... 123/446; 123/447; 123/514

(58) Field of Classification Search ..... 123/446, 123/456, 357, 514, 447, 198 F, 501
See application file for complete search history.

(56) References Cited

U.S. PATENT DOCUMENTS

| | | | | |
|---|---|---|---|---|
| 4,773,369 | A * | 9/1988 | Kobayashi et al. | 123/357 |
| 5,515,829 | A | 5/1996 | Wear et al. | |
| 5,678,521 | A * | 10/1997 | Thompson et al. | 123/447 |
| 6,000,379 | A * | 12/1999 | Stockner et al. | 123/446 |
| 6,095,118 | A * | 8/2000 | Klinger et al. | 123/446 |
| 6,668,800 | B2 * | 12/2003 | Ricco et al. | 123/446 |
| 6,672,285 | B2 * | 1/2004 | Smith et al. | 123/446 |

* cited by examiner

*Primary Examiner*—Carl S. Miller
(74) *Attorney, Agent, or Firm*—Susan L. Lukasik; Elias P. Soupos; Jeffrey P. Calfa

(57) ABSTRACT

An internal combustion engine (30) has a fueling system comprising fuel injectors (36) that utilize oil under pressure to force fuel into engine combustion chambers. Oil is pumped to an oil rail (44) by an engine-driven pump (42) whose effective displacement can be varied. A control system (32) processes certain data, such as engine speed and load, for controlling the effective displacement of the pump. The pump has a larger stage (42B) and a smaller stage (42A). The control system selects and de-selects the stages to control pump displacement.

36 Claims, 17 Drawing Sheets

CONTROL STRATEGIES FOR A VARIABLE DISPLACEMENT OIL PUMP

FIELD OF THE INVENTION

This invention relates generally to diesel engines that have fuel injectors containing electric-actuated valves that control the application of high-pressure oil, pumped by an engine-driven oil pump, to pistons, or plungers, of the fuel injectors that force diesel fuel into the engine combustion chambers. More particularly, the invention relates to strategies for controlling delivery of pressurized oil from a variable displacement type oil pump to an oil rail that serves the fuel injectors.

BACKGROUND AND SUMMARY OF THE INVENTION

Certain diesel engines that power motor vehicles use a fixed displacement type oil pump to deliver oil under pressure to an oil rail that serves electric-actuated fuel injectors. Because that type of pump is prone to associated accessory or parasitic losses that are greater than losses associated with a variable displacement type pump, use of the latter type pump should be preferred so that increased operating efficiencies can be obtained. Brake Specific Fuel Consumption (BSFC) of the engine and hence vehicle fuel economy may be improved as a result.

However, successful use of such a pump requires an appropriate control strategy. It is toward providing such a strategy that the present invention is directed.

One known type of variable displacement pump has two pumping stages. It is sometimes called a two-stage, or dual-stage, pump. Each of the two stages pumps oil independently of the other. By employing a two-stage, variable displacement pump as an oil pump in a diesel engine, a particular control strategy for selecting and de-selecting each stage forms an important element of an overall strategy for controlling flow and pressure of oil pumped to an oil rail that serves the fuel injectors. This enables the oil system to operate in a more efficient manner over a full range of engine operating conditions than one having a fixed displacement pump.

In the disclosed exemplary embodiments of the present invention, electric-controlled flow control valves are associated with each stage of the two-stage, variable displacement oil pump and are under control of the engine control system to control the shunting of pumped oil away from the oil rail and into a sump from whence the oil returns to an oil reservoir from which the pump draws oil.

When a stage is de-selected by a stage selection control strategy, the corresponding valve is maximally open to shunt the entire flow from that stage to the sump so that the stage makes no contribution to the oil being pumped to the oil rail. When a stage is selected, the corresponding valve is controlled in a manner that controls the extent to which the pumped oil is shunted to the sump.

The pressure at the oil rail is often referred to as injector control pressure, or ICP, and that pressure is under the control of an appropriate ICP control strategy that forms another element of the overall engine control strategy. The two strategies, namely the stage selection control strategy and the ICP control strategy, conjunctively enable the oil rail to provide ICP that is appropriate for engine operation over a full range of operating conditions while doing so in a manner that achieves improved engine efficiency.

An important advantage of the invention is that it provides for automatic transitional control of the flow control valves during the process of selecting a de-selected stage and during the opposite process of de-selecting a selected stage. Two different embodiments of the invention will be disclosed: a first embodiment that comprises two flow control valves, each associated with a respective stage of a two-stage, variable displacement, engine-driven oil pump, and a second embodiment that comprises an additional third flow control valve, associated with a common outlet from the two stages leading to the oil rail. In the two-valve embodiment, the valves are operated by the stage selection strategy in ways that provide gradual, rather than sudden, transitions in valve operation during selection and de-selection processes. In the three-valve embodiment that has the third valve for modulating the combined flows of the two stages, the other two valves that are associated with the respective stages are operated suddenly, rather than gradually.

A known electronic engine control system comprises a processor-based engine controller that processes data from various sources to develop control data for controlling certain functions of the engine. The engine control system controls both the duration and the timing of each fuel injection to set both the amount and the timing of engine fueling. The engine control system is also used to implement the strategy for control of the oil system, implementing both the pump stage selection strategy and the ICP control strategy.

The present invention comprises a strategy for selecting and de-selecting each stage such that at times only one stage is selected and at other times both stages are selected. The strategy for the first embodiment also makes the transition between selecting and de-selecting a stage, and vice versa, gradual, rather than sudden, by gradually operating the corresponding valve from open to closed, and vice versa.

Accordingly a generic aspect of the invention relates to an internal combustion engine comprising a fueling system comprising fuel injectors that utilize pumped hydraulic fluid, (oil being a commonly used hydraulic fluid), to force diesel fuel into engine combustion chambers and a hydraulic system comprising an engine-driven pump for pumping the fluid to the fuel injectors. The effective displacement of the pump can be varied, (stage selection of a multi-stage pump using electric-controlled valves being an example), to control the flow of pumped fluid to the fuel injectors. A control system controls the effective displacement of the pump, thereby controlling the flow of pumped fluid to the fuel injectors.

Each of the two specific embodiments of the invention that will be described comprises a two-stage pump and a control system that is effective to allow either one or both of the stages to pump oil to the fuel injectors and control the oil flow from each stage to the fuel injectors independently of the other stage. In this way, the inventive strategy promotes pumping efficiency for the oil system over a full range of engine operation, thereby avoiding losses that detract from fuel economy.

Another generic aspect relates to an internal combustion engine comprising a fueling system comprising fuel injectors that utilize pumped hydraulic fluid to force fuel into engine combustion chambers. A hydraulic system that comprises a multi-stage pump pumps hydraulic fluid to the fuel injectors. A control system selects and de-selects the pump stages for pumping fluid to the fuel injectors.

Related aspects concern methods for control of the pumped fluid as performed by the engines described above.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
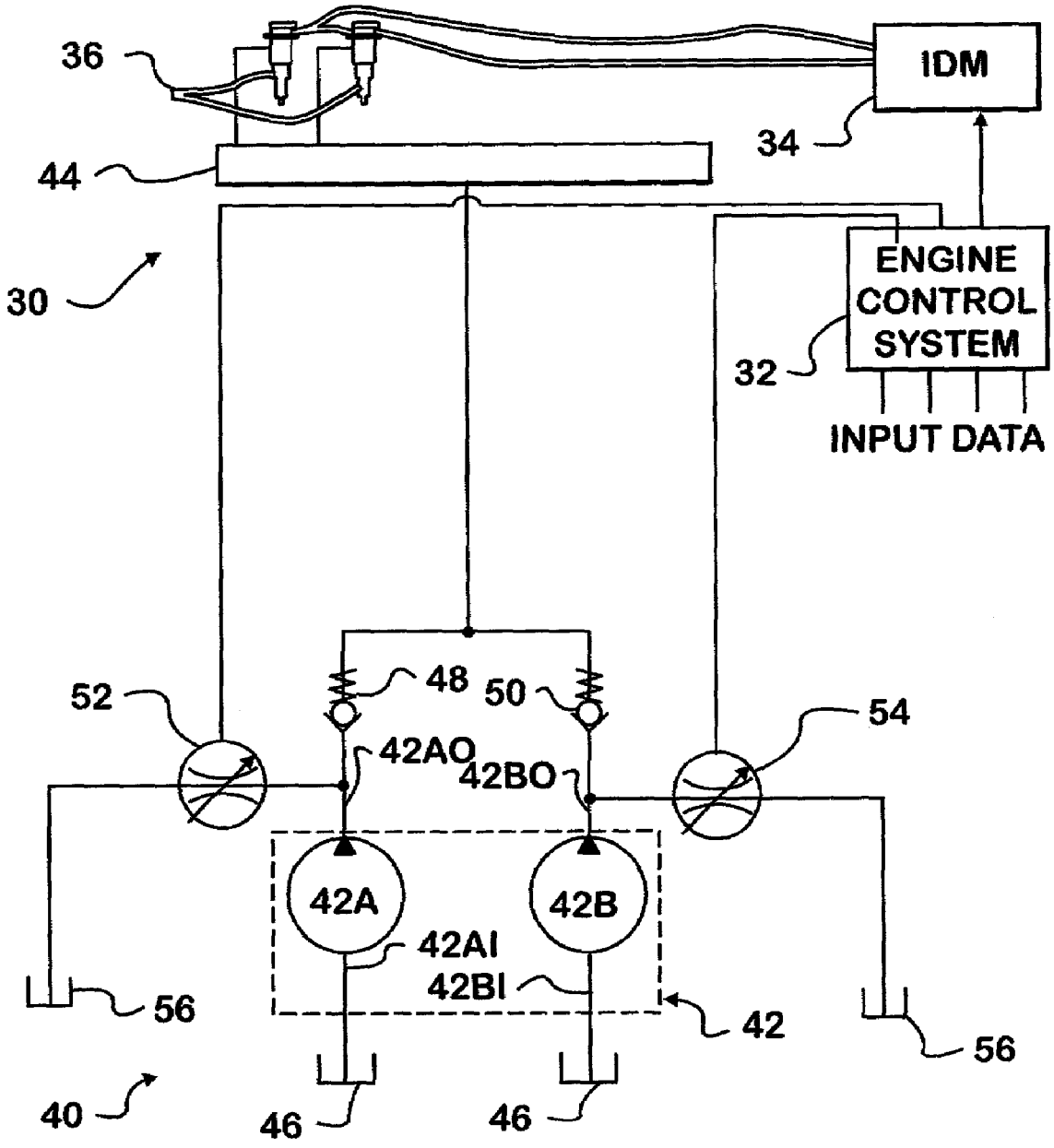
FIG. 1 is a general schematic diagram of a portion of an exemplary diesel engine relevant to an understanding of the invention, having an engine oil system, including a variable displacement oil pump, controlled in accordance with a first strategy embodying principles of the present invention.

FIG. 1 shows a schematic diagram of a portion of an exemplary diesel engine 30 relevant to an understanding of principles of the present invention. Engine 30 is used for powering a motor vehicle and comprises a processor-based engine control system 32 that processes data from various sources to develop various control data for controlling various aspects of engine operation. The data processed by control system 32 may originate at external sources, such as sensors, and/or be generated internally.

Control system 32 includes an injector driver module 34 for controlling the operation of electric-actuated fuel injectors 36 that inject fuel into engine cylinder combustion chambers. A respective fuel injector 36 is associated with each engine cylinder and comprises a body that is mounted on the engine and has a nozzle through which fuel is injected into the corresponding engine cylinder. A processor of engine control system 32 can process data sufficiently fast to calculate, in real time, the timing and duration of injector actuation to set both the timing and the amount of fueling.

Engine 30 further comprises an oil system 40 having a pump 42 for delivering oil under pressure to an oil rail 44 that serves in effect as a manifold for supplying oil to the individual fuel injectors. Pump 42 is a two-stage engine-driven pump that comprises a first stage 42A and a second stage 42B. Stage 42A is referred to as the small stage, and stage 42B as the large stage. Each stage by itself has its own fixed displacement.

Each stage comprises a respective inlet 42AI, 42BI and a respective outlet 42AO, 42BO. Each inlet 42AI, 42BI is communicated to an oil reservoir 46 from which each stage draws oil as pump 42 is being driven by engine 30. The drawn oil is then pumped from each stage through the respective outlet 42AO, 42BO. Each outlet 42AO, 42BO is communicated through a respective check valve 48, 50 to oil rail 44, and also through a respective flow control valve 52, 54 to an oil sump 56. From sump 56, oil eventually returns to reservoir 46.

Each flow control valve 52, 54 is under the control of the engine control system 32 which is effective to control the extent to which each flow control valve allows flow that will shunt pumped oil from the respective pump stage to sump 56. The pumped oil not shunted to sump 56 is delivered to oil rail 44 through the respective check valve 48, 50. The control system processes data in real time sufficiently quickly to accomplish real time control for promptly adjusting to changing engine operation. The association of each valve with a respective pump stage is considered to create a particular embodiment of variable displacement pump where the selection and de-selection of the stages by appropriate control of the valves endows the embodiment with a variable displacement characteristic.

Figure 2:
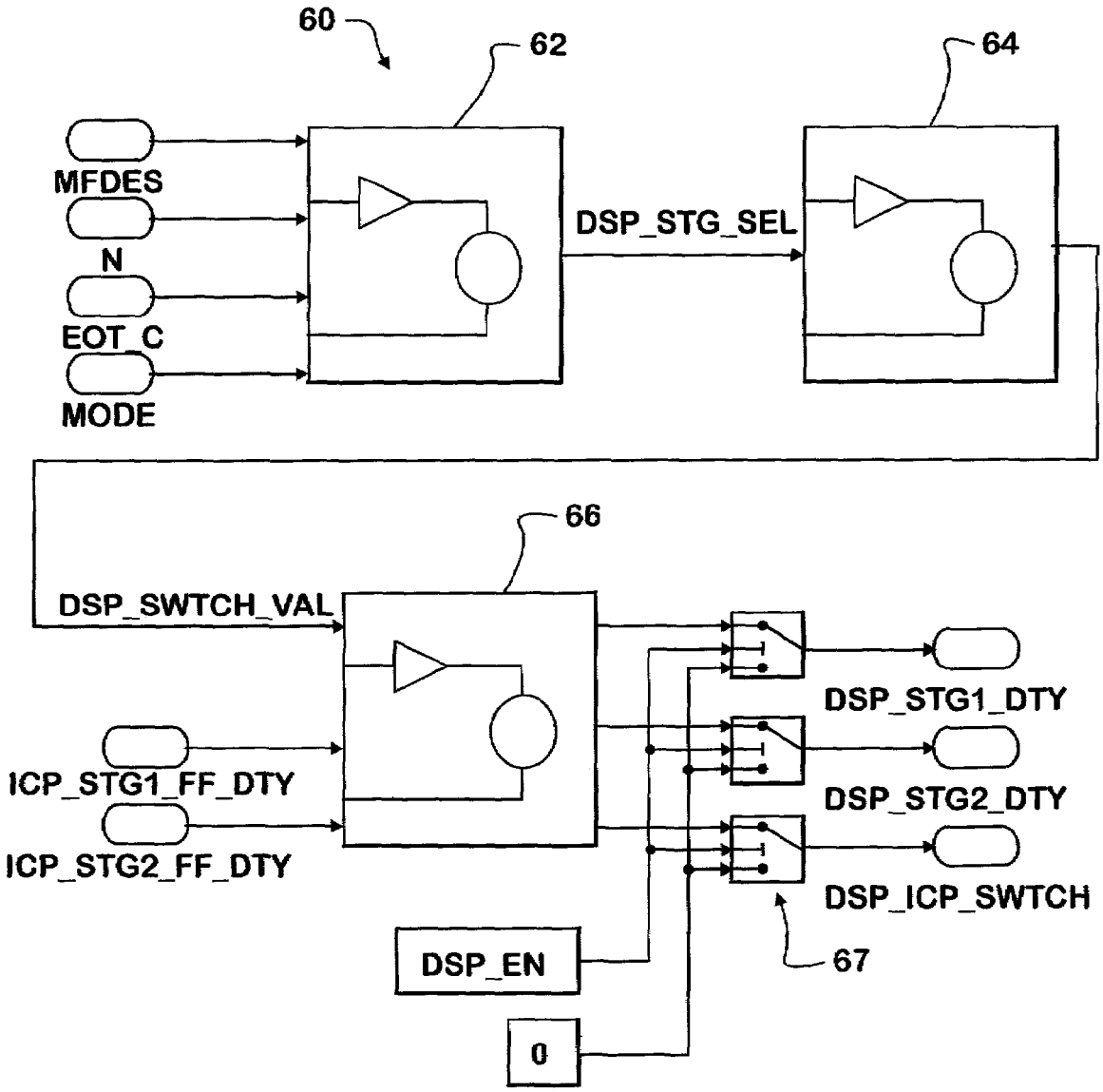
FIG. 2 is a general schematic software strategy diagram for controlling the oil system.

The inventive stage selection strategy 60 for oil system 40 is shown generally by FIG. 2 and comprises a Desired Stage Selection section 62, a Stage Switching Detection section 64, and a Stage Switching Control section 66. Input data that is processed according to strategy 60 comprises engine fueling MFDES, engine speed N, and engine oil temperature EOT. Additional data inputs utilized by the strategy, and that will be further described later, are designated MODE, ICP_STG1_FF_DTY, and ICP_STG2_FF_DTY. When the engine is being operated, the strategy is repeatedly executed at an appropriate execution rate.

A primary intent of the overall oil system control strategy is to enable pump 42 to operate in a manner that, in conjunction with ICP control strategy efficiently creates injector control pressure in oil rail 44 that is appropriate for engine operation over a full range of operating conditions. As engine operating conditions change, the strategy operates pump 42 in a manner that enables the oil rail pressure to be varied according to those conditions with the objective of securing the desired ICP for each of the many operating conditions that can occur as the engine is running. The parameter MODE defines one of three particular modes of engine operation: a "No Start" mode represented by the value "0"; a "Cranking" mode represented by the value "1"; and a "Running" mode represented by the value "2". How the prevailing mode affects the strategy will be explained later.

Desired Stage Selection section 62 repeatedly processes engine fueling data MFDES, engine speed data N, and engine oil temperature data EOT to develop output data DSP_STG_SEL for selecting either one or both pump stages 42A, 42B to pump oil to oil rail 44. A value of "1" for output data DSP_STG_SEL means that only pump stage 42A should pump oil to oil rail 44. A value of "2" for output data DSP_STG_SEL means that only pump stage 42B should pump oil to oil rail 44. A value of "3" for output data DSP_STG_SEL means that both pump stages 42A, 42B should pump oil to oil rail 44.

Stage Switching Detection section 64 detects a change in the value of output data DSP_STG_SEL provided by Desired Stage Selection section 62. In particular, Stage Switching Detection section 64 is capable of detecting all six possible changes and providing a corresponding value for a data output DSP_SWTCH_VAL that is indicative of the particular change.

When the value of output data DSP_STG_SEL changes from a "1" to a "2" to cause the pump stage selection to switch from stage 42A to stage 42B, Stage Switching Detection section 64 sets the value of DSP_SWTCH_VAL at "1".

When the value of output data DSP_STG_SEL changes from a "2" to a "1" to cause the pump stage selection to switch from stage 42B to stage 42A, Stage Switching Detection section 64 sets the value of DSP_SWTCH_VAL at "2".

When the value of output data DSP_STG_SEL changes from a "1" to a "3" to cause the pump stage selection to switch from stage 42A to both stages 42A, 42B, Stage Switching Detection section 64 sets the value of DSP_SWTCH_VAL at "3".

When the value of output data DSP_STG_SEL changes from a "2" to a "3" to cause the pump stage selection to switch from stage 42B to both stages 42A, 42B, Stage Switching Detection section 64 sets the value of DSP_SWTCH_VAL at "4".

When the value of output data DSP_STG_SEL changes from a "3" to a "1" to cause the pump stage selection to switch from both stages 42A, 42B to only stage 42A, Stage Switching Detection section 64 sets the value of DSP_SWTCH_VAL at "5".

When the value of output data DSP_STG_SEL changes from a "3" to a "2" to cause the pump stage selection to switch from both stages 42A, 42B to only stage 42B, Stage Switching Detection section 64 sets the value of DSP_SWTCH_VAL at "6".

Stage Switching Control section 66 determines the extent to which the stages should pump oil to oil rail 44 during the stage selection switching process by operating each of the flow control valves 52, 54 to shunt a proper amount of oil from the respective pump stage outlet so that the total amount of oil being pumped through check valves 48, 50 secures an ICP appropriate for the present engine operating conditions.

The extent to which Stage Switching Control section 66 allows a selected pump stage to pump oil is controlled by a respective duty cycle signal applied to the respective flow control valve. The duty cycle signal being applied to a respective flow control valve sets the extent to which that valve allows flow through itself to sump 56. The particular valves in the present embodiment are normally open in the absence of a duty cycle signal. Hence, as a duty signal increases from some minimum toward some maximum, the valve to which it is being applied will increasingly close to allow increasing flow to oil rail 44.

The duty cycle of the signal applied to valve 52 is established by the value of data DSP_STG1_DTY provided by Stage Switching Control section 66. The duty cycle of the signal applied to valve 54 is established by the value of data DSP_STG2_DTY provided by Stage Switching Control section 66. Stage Switching Control section 66 calculates values for DSP_STG1_DTY and DSP_STG2_DTY by processing the value of DSP_SWTCH_VAL furnished by Stage Switching Detection section 64 and the values of ICP_STG1_FF_DTY, and ICP_STG2_FF_DTY that were mentioned earlier. Data values of ICP_STG1_FF_DTY, and ICP_STG2_FF_DTY are supplied to stage selection strategy 60 from the ICP strategy (details of which are not shown because principles of the present invention are independent of them), and those values are determined by the ICP strategy on the basis of various engine operating parameters that may include engine speed N, engine fueling MFDES, and engine temperature EOT. Engine fueling MFDES is indicative of engine load.

The value of ICP_STG1_FF_DTY represents a target value for the duty cycle of DSP_STG1_DTY that is intended to cause valve 52 to respond promptly and appropriately, in accordance with the inventive strategy, when pump stage 42A is selected and a change in the value of the duty cycle applied to valve 52 is called for as a result of the processing of fueling, engine speed, and engine temperature data. Similarly, the value of ICP_STG2_FF_DTY represents a target value for the duty cycle of DSP_STG2_DTY that is intended to cause valve 54 to respond promptly and appropriately, in accordance with the inventive strategy, when pump stage 42B is selected and a change in the value of the duty cycle applied to valve 54 is called for as a result of the processing of fueling, engine speed, and engine temperature data. The disclosed strategy contemplates that when both stages are being selected, one of them will deliver to the oil rail all of the oil that it is pumping, while the extent to which the valve of the other stage is allowing oil to be pumped to the rail is set by the duty cycle of the voltage being applied to it, and that duty cycle is being controlled by the ICP strategy to achieve the desired ICP. When a pump stage, that was not being selected, becomes selected, Stage Switching Control section 66 functions to gradually increase the duty cycle of the corresponding signal being applied to the corresponding valve 52, 54 to a value calculated by the ICP control strategy to create the desired ICP. As the duty cycle to a valve gradually increases, the valve increasingly restricts the flow to the sump, causing more oil from the corresponding pump stage to be diverted to oil rail 44 to create the desired ICP.

When a pump stage, that was being selected, becomes de-selected, Stage Switching Control section 66 functions to gradually decrease the duty cycle of the corresponding signal being applied to the corresponding valve 52, 54 to a zero value. As the duty cycle to a valve gradually decreases, the valve decreasingly restricts the flow to the sump, causing more oil from the corresponding pump stage to be diverted from oil rail 44 to the sump until all oil from that stage is diverted to the sump.

Because DSP_STG1_DTY and DSP_STG2_DTY represent only data values for the respective duty cycles, it should be understood that the actual duty cycle voltages applied to the respective flow control valves are developed from the data via respective electric circuits that are not shown in the drawing. Data from Stage Switching Control section 66 passes to those circuits through software switches 67 that are switched off when an "enable" data signal DSP_EN ceases to be applied to the switches. Hence, it should be understood that the "enable" signal must be present for the dual stage control strategy to switch the stages.

A data value for a parameter DSP_ICP_SWTCH is also passed by one of the switches 67 when the enable data signal is present. That parameter informs the ICP strategy of which stage or stages is or are being selected, and its value will change to reflect the stage selection changes, as will be more fully explained later.

Figure 3:
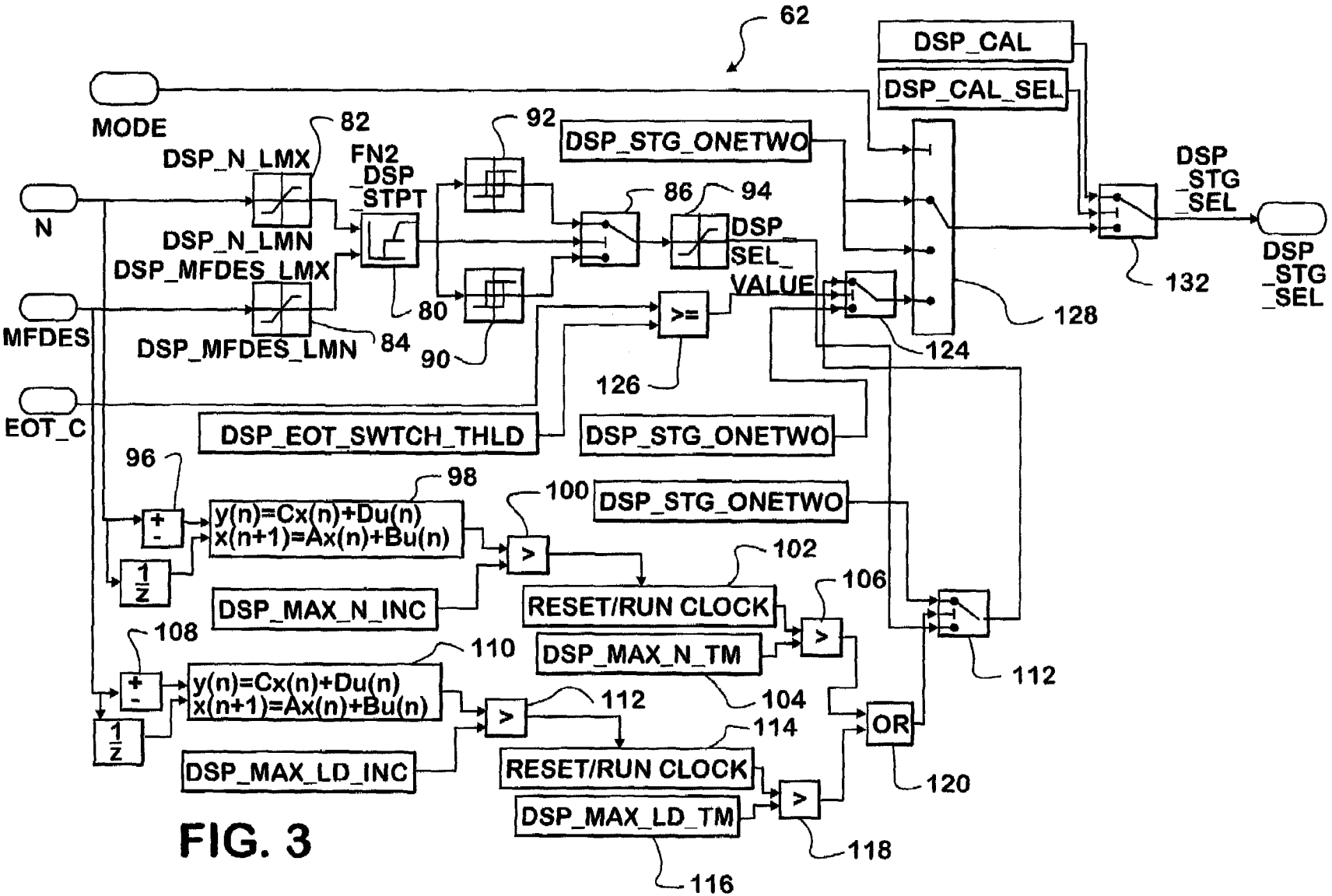
FIG. 3 is a schematic software strategy diagram showing more detail of a first portion of the general strategy of FIG. 2.

FIG. 3 shows detail of the processing performed by Desired Stage Selection section 62. A map, or look-up table, 80 (FN2_DSP_STPT) correlates various strategy set points with values of engine speed and engine fueling. For each set of values of engine speed and engine fueling, the map provides a corresponding set point. Values of engine speed and engine fueling span essentially the full ranges of speed and fueling so as to enable a set point to be selected at essentially all engine operating conditions.

The data values for engine speed N and engine fueling MFDES are first validated by respective limit functions 82, 84 to assure that they are within valid ranges. If a data value for engine speed is out of range either maximally or minimally, a corresponding maximum or minimum limit value (DSP_N_LMX or DSP_N_LMN) is instead used as a speed data input to map 80. If a data value for engine fueling is out of range either maximally or minimally, a corresponding maximum or minimum limit value (DSP_MFDES_LMX or DSP_MFDES_LMN) is instead used as a fueling data input to map 80.

The selected set point value is also used to select one of two hysteresis characteristics 90, 92 that are intended to avoid the influence of certain fluctuations in the set point data furnished by map 80 when the strategy calls for the set point to change based on changes in the inputs to map 80. A switch 86 selects one of the two functions 90, 92 based on the set point value. A reason for having selectable hysteresis functions is to provide different amounts of hysteresis when switching from different set points.

There are three possible set points: Set Point 1, Set Point 2, and Set Point 3. Set Point 1 causes pump stage 42A to be selected; Set Point 2 causes pump stage 42B to be selected; and Set Point 3 causes both pump stages to be selected. Although the set point is determined by the integer part of the result from map 80, a limit function 94 is used to assure the set point remains within the range of one to three.

Upon a new iteration of the processing strategy, a comparison function 96 subtracts from the present value of engine speed N, the value that was used during the immediately previous iteration. Noise that may be present in the result is filtered out using an appropriate filtering function 98. The filtered result is compared by a comparison function 100 with a value DSP_MAX_N_INC that has been predetermined to define a possible acceleration transient to which strategy reaction may be appropriate. If the result of the comparison discloses that an acceleration is commencing, a clock 102 is started.

The process is repeated at each iteration. So long as each iteration discloses continued acceleration, clock 102 continues running. Elapsed running time of the clock is compared against a preset time interval 104 (DSP_MAX_N_TM) by a comparison function 106. When function 106 detects that elapsed clock time has exceeded interval 104, a data output that signals the transient is given. How the strategy reacts will be explained in more detail later.

A fueling transient is indicated by similar processing of engine fueling MFDES. Upon a new iteration of the processing strategy, a comparison function 108 subtracts from the present value of engine fueling MFDES, the value that was used during the immediately previous iteration. Noise is filtered out by a filtering function 110. The filtered result is compared by a comparison function 112 with a value DSP_MAX_LD_INC that has been predetermined to define a possible fueling transient to which strategy reaction may be appropriate. If the result of the comparison discloses that increasing engine fueling (indicative of an increase in engine load) is commencing, a clock 114 is started. So long as each successive iteration discloses continued increasing fuel, clock 114 continues running, and elapsed running time is compared against a preset time interval 116 (DSP_MAX_LD_TM) by a comparison function 118. When function 118 detects that elapsed clock time has exceeded interval 116, a data output that signals the transient is given.

A logical OR function 120 enables either a confirmed engine acceleration transient or a confirmed increased fueling transient to select both pump stages 42A, 42B. In the absence of any such transient, the set point (DSP_SEL_VALUE) provided by limit function 94 controls pump stage selection. When either a confirmed engine acceleration transient or a confirmed increased fueling transient occurs, a switch 122 assumes a state that passes a data value DSP_STG_ONETWO to another switch 124. In the absence of any such transient, switch 122 passes the set point (DSP_SEL_VALUE) established by limit function 94 to switch 124. The data value for DSP_STG_ONETWO is equivalent to the one that indicates Set Point 3.

The data value for engine oil temperature EOT is indicative of engine operating temperature. A comparison function 126 compares the value of EOT with a threshold value DSP_EOT_SWTCH_THLD that has been determined to distinguish a cold engine from one that has been warmed up. The result of the comparison controls switch 124. When a cold engine is indicated, switch 124 assumes a state that passes the data value for DSP_STG_ONETWO, indicating Set Point 3, to a further switch 128. When a warmed up engine is indicated, switch 124 assumes a state that passes whatever data value is being passed by switch 122.

When electric power is being applied to engine control system 32, but engine 30 is neither running nor being cranked, the strategy resides in the "No Start" mode, and the data value for the parameter MODE is "0". When electric power is being applied to engine control system 32, and engine 30 is being cranked, the strategy resides in the "Cranking" mode, and the data value for the parameter MODE is "1". When electric power is being applied to engine control system 32, and engine 30 is running, the strategy resides in the "Running" mode, and the data value for the parameter MODE is "2".

The data value of MODE is passed to switch 128. In both the "No Start" and "Cranking" modes, the DSP_STG_ONETWO value is passed by switch 128 to yet another switch 132. In the "Running" mode, the data value being passed by switch 124 is passed by switch 128 to switch 132. Switch 132 normally passes the data value being passed by switch 128. For the purpose of calibration and/or diagnosis, switch 132 can operate to a different state that allows it to pass a calibration value DSP_CAL instead of the data value being passed by switch 128.

From the foregoing description then, one can appreciate that in both "No Start" and "Cranking" modes, both pump stages 42A, 42B are being selected by the strategy. In the former mode, the engine is not operating, and consequently neither is pump 42 so that no ICP is being developed while the engine is off. In the latter mode, the engine is being cranked and is therefore capable of operating pump 42 to pump oil to oil rail 44. Both stages are selected during cranking to develop ICP as quickly as possible so that the engine will start and commence running under its own power as quickly as possible.

In the "Running" mode, one or both pump stages 42A, 42B may be selected by the strategy in accordance with the stage selection processing of section 62 that has been described above.

Figure 4:
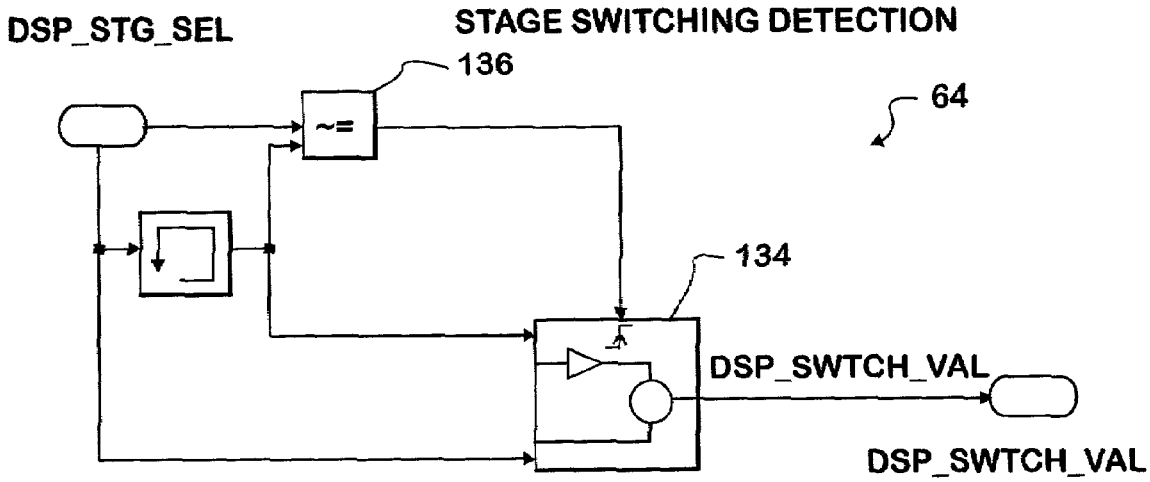
FIG. 4 is a schematic software strategy diagram showing more detail of a second portion of the general strategy of FIG. 2.

Detail of stage switching detection section is presented by FIG. 4. The data value of DSP_SWTCH_VAL is determined by the data value of DSP_STG_SEL, and will change when the data value of DSP_STG_SEL changes. A Stage Switching Value Selection section 134 is triggered when a change detection function 136 detects a change in the data value of DSP_STG_SEL. At each iteration of the processing, function 136 compares the current (i.e. new) data value of DSP_STG_SEL with the immediately previous (i.e. old) one, and will trigger section 134 when there is a difference. The new and old data values of DSP_STG_SEL are then processed by section 136 to cause the proper change in the data value of DSP_SWTCH_VAL.

Figure 5:
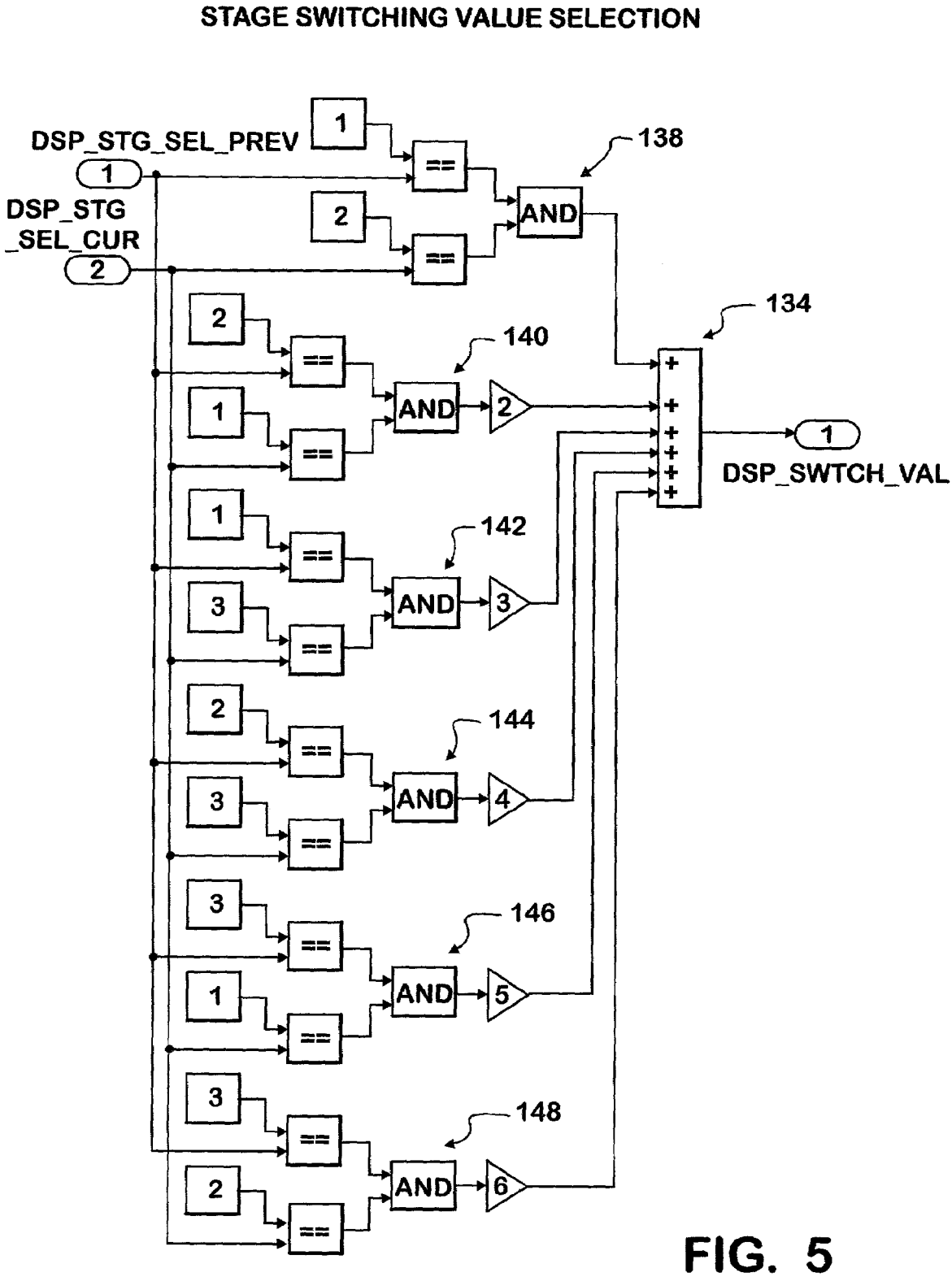
FIG. 5 is a schematic software strategy diagram showing more detail of a portion of FIG. 4.

FIG. 5 shows detail of Stage Switching Value Selection section 134. The current (i.e. new) data value of DSP_STG_SEL is designated DSP_STG_SEL_CUR, and the immediately previous (i.e. old) data value is designated DSP_STG_SEL_PREV. Both values are processed along six parallel paths 138, 140, 142, 144, 146, and 148. Each path comprises a processing function that serves to identify how the data value of DSP_STG_SEL changed. There are, as explained earlier, six possibilities, and each path is structured to identify a particular one of those possibilities. When the particular path that identifies the particular change for which it has been structured, identifies that change, it causes the data value for DSP_SWTCH_VAL to assume the corresponding value, and that value will be either a "1", "2", "3", "4", "5" or "6".

Figure 6:
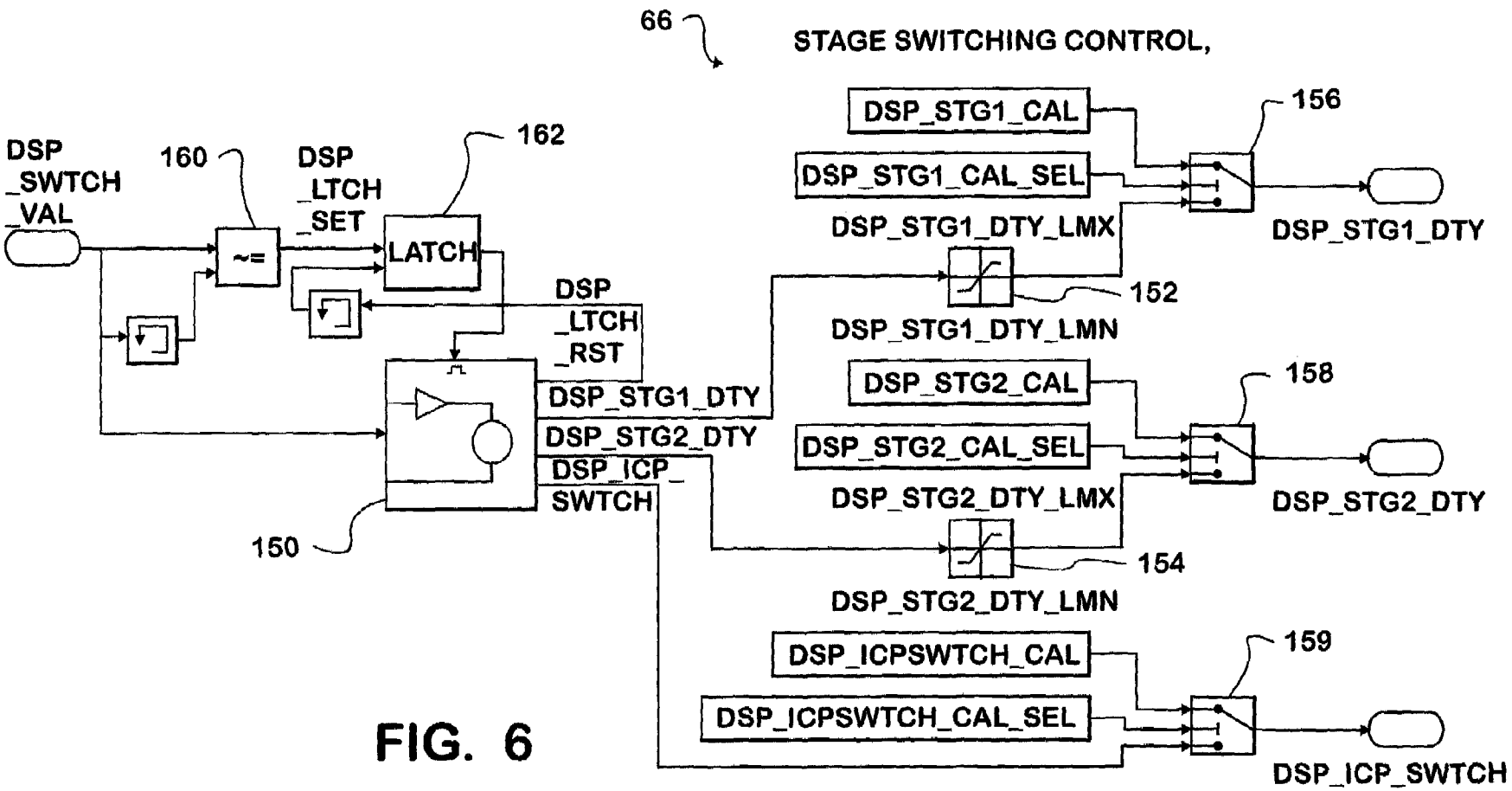
FIG. 6 is a schematic software strategy diagram showing more detail of a third portion of the general strategy of FIG. 2.

Detail of Stage Switching Control Selection section 66 is disclosed in FIG. 6. As long as the data value for DSP_SWTCH_VAL remains unchanged, a Valve Switching Control section 150 passes one or both data values for ICP_STG1_FF_DTY and ICP_STG2_FF_DTY in accordance with the particular data value for DSP_SWTCH_VAL. DSP_STG1_DTY and DSP_STG2_DTY represent the passed data values.

The passed data values for both DSP_STG1_DTY and DSP_STG2_DTY are validated by respective limit functions 152, 154 to assure that they are within valid ranges. If a data value for DSP_STG1_DTY is out of range either maximally or minimally, a corresponding maximum or minimum limit value (DSP_STG1_DTY_LMX or DSP_STG1_DTY_LMN) is instead used as the value for the duty cycle of the voltage to be applied to the first pump stage flow control valve. If a data value for DSP_STG2_DTY is out of range either maximally or minimally, a corresponding maximum or minimum limit value (DSP_STG2_DTY_LMX or DSP_STG2_DTY_LMN) is instead used as the value for the duty cycle of the voltage to be applied to the second pump stage flow control valve.

A switch 156 normally passes the data value provided by limit function 152. For the purpose of calibration and/or diagnosis when called for by DSP_STG1_CAL SEL, switch 156 can operate to a different state that allows it to pass a calibration value DSP_STG1_CAL instead of the data value provided by limit function 152.

Similarly, a switch 158 normally passes the data value provided by limit function 154. For the purpose of calibration and/or diagnosis when called for by DSP_STG2_CAL SEL, switch 158 can operate to a different state that allows it to pass a calibration value DSP_STG2_CAL instead of the data value provided by limit function 154.

A switch 159 normally passes the data value for DSP_ICP SWTCH. For the purpose of calibration and/or diagnosis when called for by DSP_ICPSWTCH_CAL_SEL, switch 159 can operate to a different state that allows it to pass a calibration value DSP_ICPSWTCH_CAL instead of the data value DSP_ICP_SWTCH.

When the data value for DSP_SWTCH_VAL changes, Valve Switching Control section 150 detects the change and takes action that is appropriate for the particular change that it has detected. Section 150 is triggered when a change detection function 160 detects a change in the data value of DSP_SWTCH_VAL. At each iteration of the processing, function 160 compares the current (i.e. new) data value of DSP_SWTCH_VAL with the immediately previous (i.e. old) one, and will set a latch function 162 when a change is detected. It is the setting of latch function 162 that triggers section 150. The latch function remains set during a transition time during which the stage selection is changing from the previous one to a different selection that is defined by the new data value for DSP_SWTCH_VAL.

Figure 7:
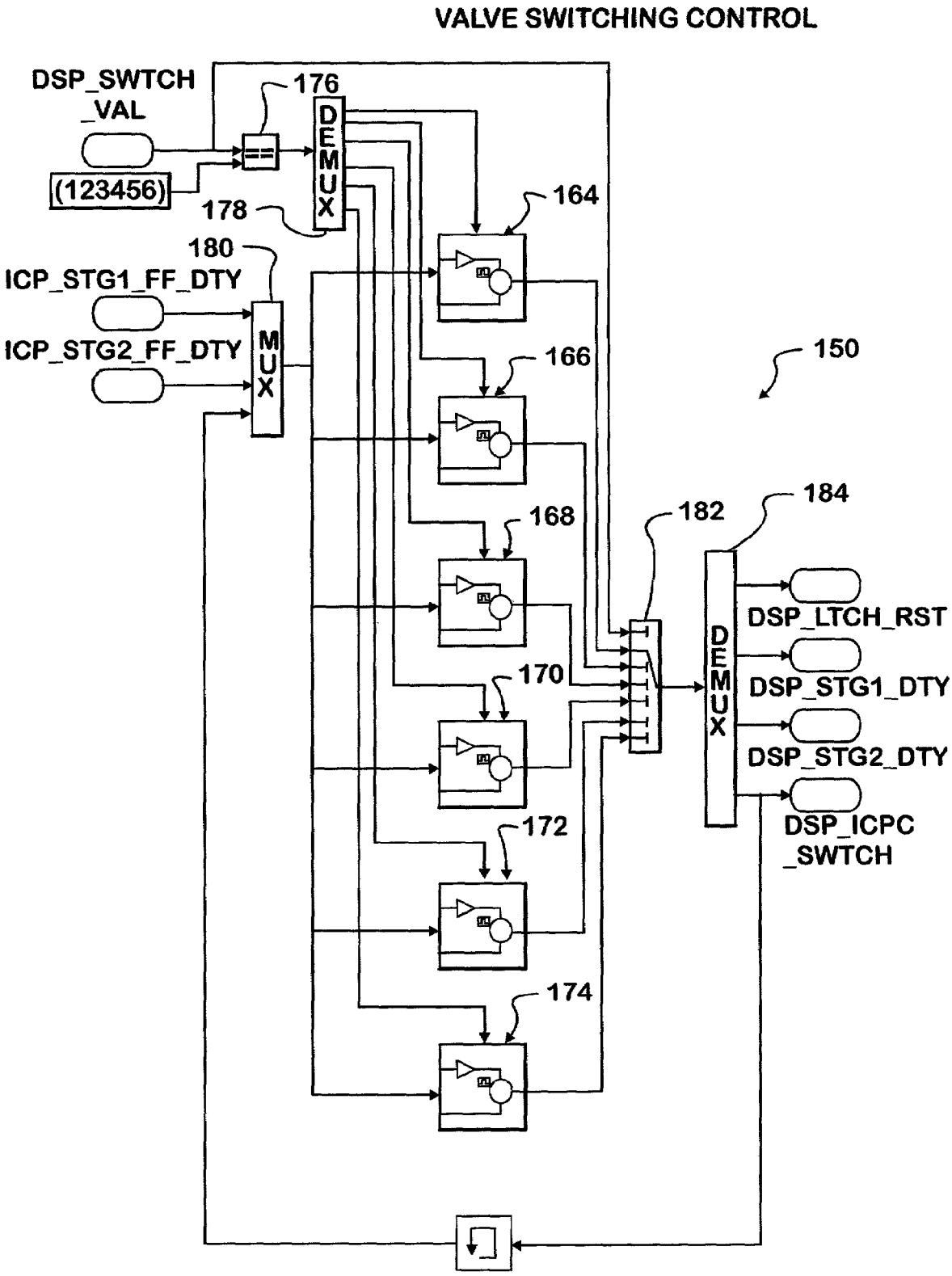
FIG. 7 is a schematic software strategy diagram showing more detail of a portion of FIG. 6.

Transitions that avoid suddenly either applying or removing a duty cycle voltage to or from a flow control valve, and instead either gradually increase or gradually decrease the duty cycle being applied, depending on whether a stage is being selected or de-selected, are considered desirable. For each of the six possible ways in which stage selection can change, Valve Switching Control section 150 provides that sort of transition. The strategy comprises six processing paths 164, 166, 168, 170, 172, and 174 shown in FIG. 7.

The new data value of DSP_SWTCH_VAL is detected by an identifying function 176. A demultiplex function 178 enables the processing path that corresponds to that new data value. A multiplex function 180 multiplexes the values of ICP_STG1_FF_DTY and ICP_STG2_FF_DTY to the enabled processing path. The new data value of DSP_SWTCH_VAL also operates a switch 182 so that data from the enabled processing path can pass to a demultiplex function 184.

Rather than causing the actual value of the appropriate one or ones of ICP_STG1_FF_DTY and ICP_STG2_FF_DTY to immediately pass through the enabled processing path and ultimately form corresponding data values for DSP_STG1_DTY and/or DSP_STG2_DTY, the enabled processing path creates a gradual transition, either increasing the duty cycle value toward the actual value of the appropriate one or ones of ICP_STG1_FF_DTY and ICP_STG2_FF_DTY, or decreasing the duty cycle value of the appropriate one or ones of ICP_STG1_FF_DTY and ICP_STG2_FF_DTY. In two of the six switching possibilities however, the actual value of ICP_STG1_FF_DTY in one instance (FIG. 11), and the actual value of ICP_STG2_FF_DTY in the other instance (FIG. 13), immediately pass through the corresponding processing path to form the corresponding data value for DSP_STG1_DTY in the one instance and for DSP_STG2_DTY in the other instance.

When the transition has been completed, the enabled processing path issues a reset signal DSP_LTCH_RST that resets latch function 162 so that any subsequent change in the data value of DSP_SWTCH_VAL can be detected by section 66.

Detail of the processing strategy for each of the six processing paths 164, 166, 168, 170, 172, and 174 is shown in a respective one of FIGS. 8–13. For this example that is being described, the strategy is premised on the assumption that if both pump stages are to be selected for concurrent pumping to oil rail 44, then one of the stages, stage 42A in this example, is to deliver 100% of its output to the oil rail, and as will be seen, that is reflected in FIGS. 10 and 11.

Figure 8:
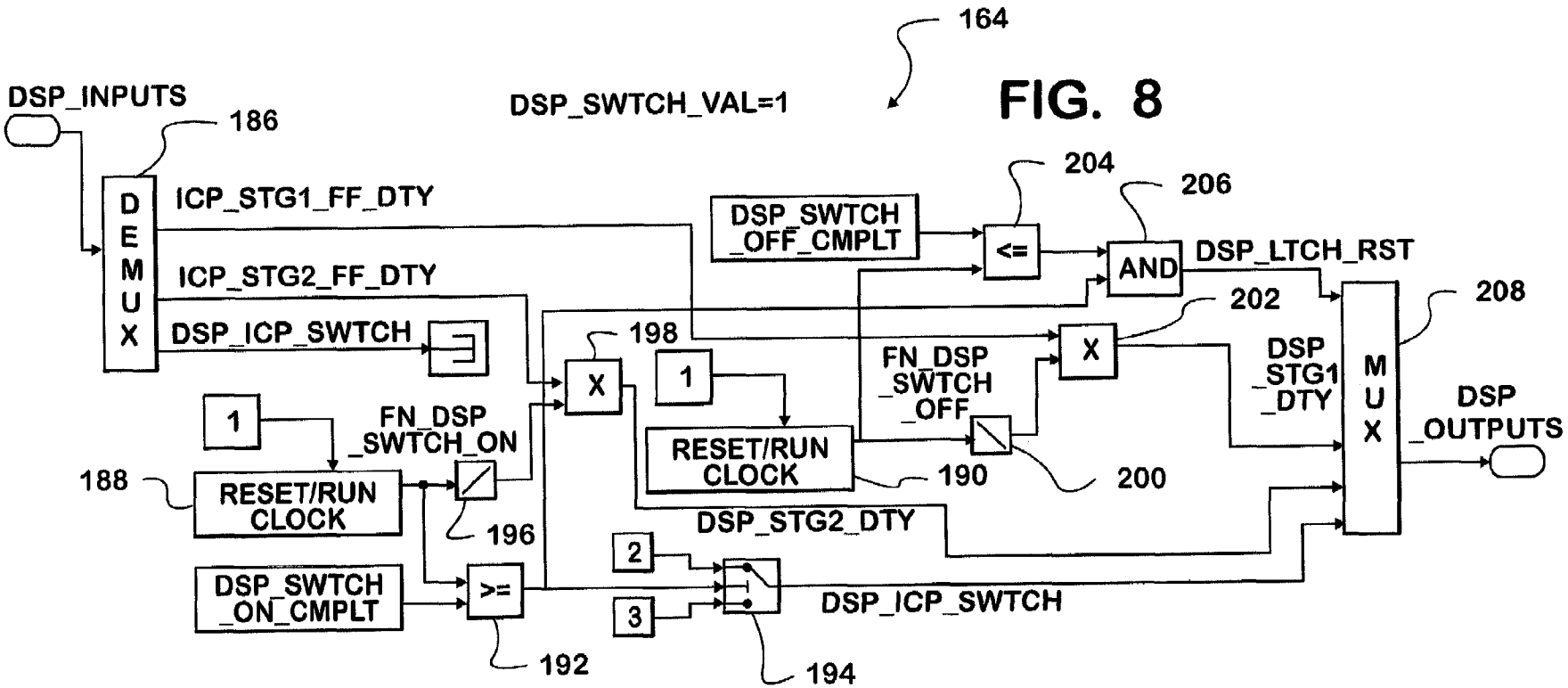
FIGS. 8–13 are schematic software strategy diagrams showing more detail respective portions of FIG. 7.

The processing strategy for path 164 switches from selecting pump stage 42A to selecting pump stage 42B. Hence, stage 42A is de-selected. The strategy is shown in FIG. 8 to comprise a demultiplex function 186 that demultiplexes the data provided by multiplex function 180 to enable processing of the data values for ICP_STG1_FF_DTY and ICP_STG2_FF_DTY to accomplish a gradual switching transition where the selection of stage 42B occurs gradually, rather than suddenly, and the deselection of stage 42A also occurs gradually, rather than suddenly.

Upon path 164 being enabled, two clocks 188, 190 are started. At each iteration of processing, elapsed running time on clock 188 is compared with a data value of a parameter DSP_SWTCH_ON_CMPLT by a comparison function 192. DSP_SWTCH_ON_CMPLT defines the time interval allotted for completing the transition for the selected stage. Initially a switch 194 is indicating the value of the parameter DSP_ICP_SWTCH as "3", informing the ICP control strategy that the pump stage selection is in the process of changing. Switch 194 continues to indicate that state until clock 188 has timed for the interval defined by the value of DSP_SWTCH_ON_CMPLT. When that happens, switch 194 switches to indicate the value of the parameter DSP_ICP_SWTCH as "2", informing the ICP control strategy that the process of selecting stage 42B has now been completed.

As clock 188 is timing, a function 196 (FN_DSP_SWTCH_ON) utilizes the elapsed time to create a multiplier that is utilized by a multiplication function 198. The multiplier increases as a function of time from an initial value of zero to a final value of unity. At each iteration of the strategy, multiplication function 198 multiplies ICP_STG2_FF_DTY by the current value of the multiplier. The resulting product is a value for DSP_STG2_DTY.

As clock 190 is timing, a function 200 (FN_DSP_SWTCH_OFF) utilizes the elapsed time to create a multiplier that is utilized by a multiplication function 202. The multiplier decreases as a function of time from an initial value of unity to a final value of zero. At each iteration of the strategy, multiplication function 202 multiplies ICP_STG1_FF_DTY by the current value of the multiplier. The resulting product is a value for DSP_STG1_DTY.

At each iteration of processing, elapsed running time on clock 190 is compared with a data value of a parameter DSP_SWTCH_OFF_CMPLT by a comparison function 204. DSP_SWTCH_OFF_CMPLT defines the time interval allotted for completing the transition for the de-selected stage. When function 204 detects that elapsed clock time has exceeded the time allotted by DSP_SWTCH_OFF_CMPLT, a signal is given to an AND function 206. Another signal is given to AND function 206 when function 192 detects that elapsed clock time has exceeded the time allotted by DSP_SWTCH_ON_CMPLT. When AND function 206 detects that both allotted time intervals have elapsed, the value of DSP_LTCH_RST changes to cause latch function 162 to be reset. Values for DSP_LTCH_RST, DSP_STG1_DTY, DSP_STG2_DTY, and DSP_ICP_SWTCH are processed through a multiplex function 208 before passing through switch 182 to demultiplex function 184.

Once set, latch function 162 remains so until reset upon completion both of selecting pump stage 42B and of de-selecting pump stage 42A. Hence, even if the data value for DSP_SEL_VALUE furnished by limit function 94 were to change once a change in stage selection has been initiated, latch function 162 cannot be reset until the change has been completed.

Figure 9:
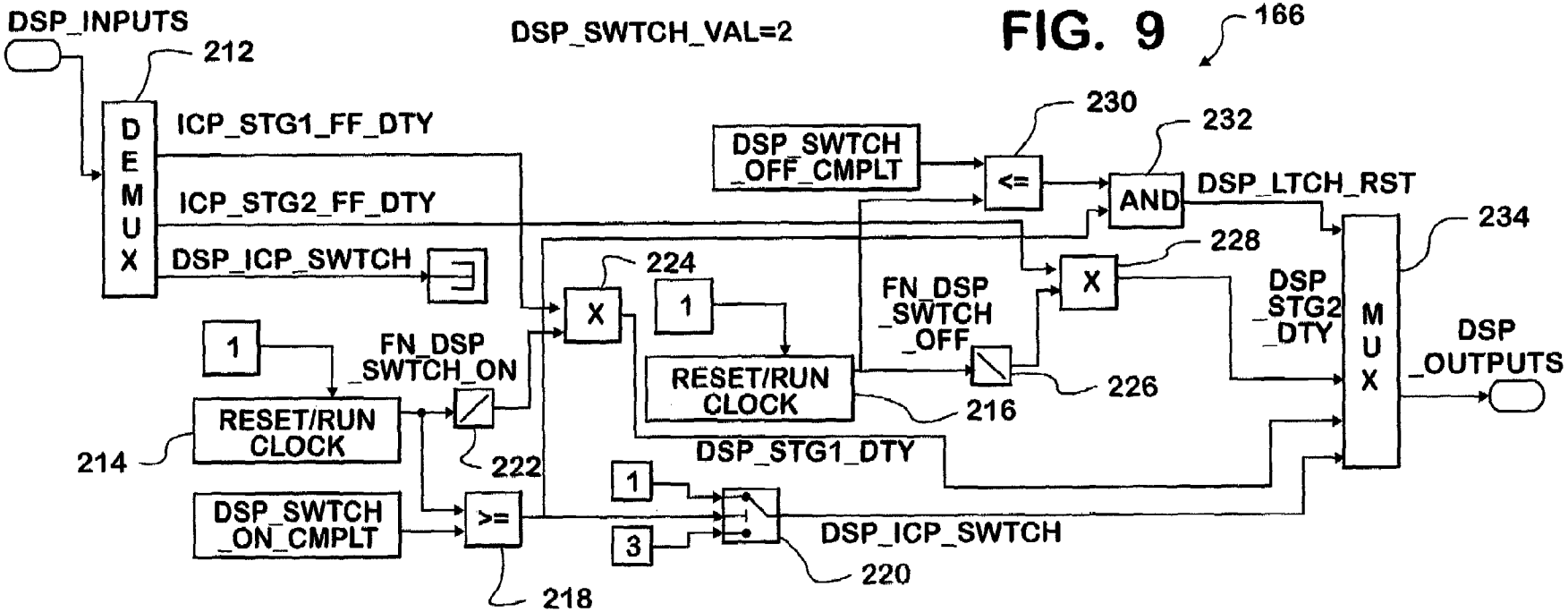

The processing strategy for path 166 switches from selecting pump stage 42B to selecting pump stage 42A. Hence, stage 42B is de-selected. The strategy is shown in FIG. 9 to comprise a demultiplex function 212 that demultiplexes the data provided by multiplex function 180 to enable processing of the data values for ICP_STG1_FF_DTY and ICP_STG2_FF_DTY to accomplish a gradual switching transition where the selection of stage 42A occurs gradually, rather than suddenly, and the deselection of stage 42B also occurs gradually, rather than suddenly.

Upon path 166 being enabled, two clocks 214, 216 are started. At each iteration of processing, elapsed running time on clock 214 is compared with a data value of a parameter DSP_SWTCH_ON_CMPLT by a comparison function 218. DSP_SWTCH_ON_CMPLT defines the time interval allotted for completing the transition for the selected stage. Initially a switch 220 is indicating the value of the parameter DSP_ICP_SWTCH as "3", informing the ICP control strategy that the pump stage selection is in the process of changing. Switch 220 continues to indicate that state until clock 214 has timed for the interval defined by the value of DSP_SWTCH_ON_CMPLT. When that happens, switch 220 switches to indicate the value of the parameter DSP_ICP_SWTCH as "1", informing the ICP control strategy that the selection of stage 42A has now been completed.

As clock 214 is timing, a function 222 (FN_DSP_SWTCH_ON) utilizes the elapsed time to create a multiplier that is utilized by a multiplication function 224. The multiplier increases as a function of time from an initial value of zero to a final value of unity. At each iteration of the strategy, multiplication function 224 multiplies ICP_STG1_FF_DTY by the current value of the multiplier. The resulting product is a value for DSP_STG1_DTY.

As clock 216 is timing, a function 226 (FN_DSP_SWTCH_OFF) utilizes the elapsed time to create a multiplier that is utilized by a multiplication function 228. The multiplier decreases as a function of time from an initial value of unity to a final value of zero. At each iteration of the strategy, multiplication function 228 multiplies ICP_STG2_FF_DTY by the current value of the multiplier. The resulting product is a value for DSP_STG2_DTY.

At each iteration of processing, elapsed running time on clock 216 is compared with a data value of a parameter DSP_SWTCH_OFF_CMPLT by a comparison function 230. DSP_SWTCH_OFF_CMPLT defines the time interval allotted for completing the transition for the de-selected stage. When function 230 detects that elapsed clock time has exceeded the time allotted by DSP_SWTCH_OFF_CMPLT, a signal is given to an AND function 232. Another signal is given to AND function 232 when function 218 detects that elapsed clock time has exceeded the time allotted by DSP_SWTCH_ON_CMPLT. When AND function 232 detects that both allotted time intervals have elapsed, the value of DSP_LTCH_RST changes to cause latch function 162 to be reset. Values for DSP_LTCH_RST, DSP_STG1_DTY, DSP_STG2_DTY, and DSP_ICP_SWTCH are processed through a multiplex function 234 before passing through switch 182 to demultiplex function 184.

The processing strategy for path 168 switches from selecting only pump stage 42A to selecting both pump stages 42A, 42B. The path strategy must therefore fulfill the premise mentioned earlier that at the conclusion of the switching transition, the maximum duty cycle will be applied to close valve 52 so that stage 42A will then be pumping 100% of its output to oil rail 44.

Figure 10:
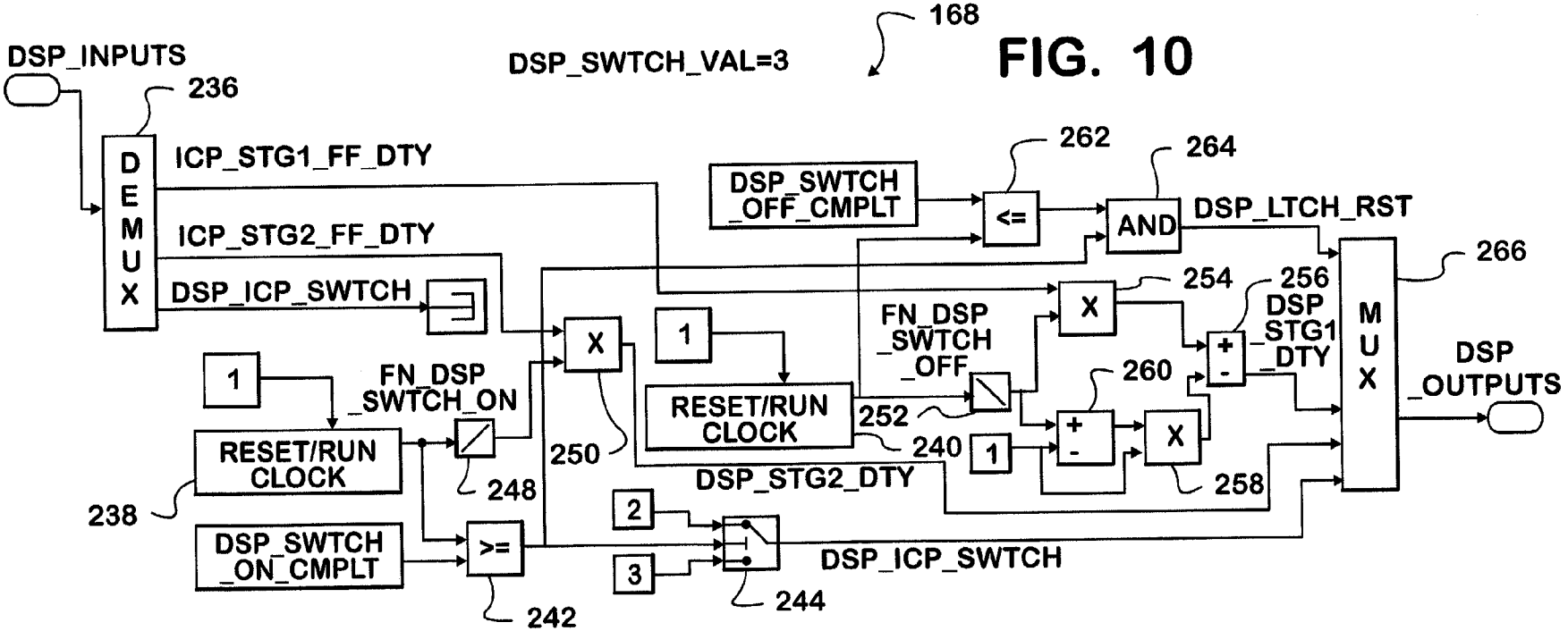

The strategy is shown in FIG. 10 to comprise a demultiplex function 236 that demultiplexes the data provided by multiplex function 180 to enable processing of the data values for ICP_STG1_FF_DTY and ICP_STG2_FF_DTY to accomplish a gradual switching transition.

Upon path 168 being enabled, two clocks 238, 240 are started. At each iteration of processing, elapsed running time on clock 238 is compared with a data value of a parameter DSP_SWTCH_ON_CMPLT by a comparison function 242. DSP_SWTCH_ON_CMPLT defines the time interval allotted for completing the transition for selecting stage 42B. Initially a switch 244 is indicating the value of the parameter DSP_ICP_SWTCH as "3", informing the ICP control strategy that the pump stage selection is in the process of changing. Switch 244 continues to indicate that state until clock 238 has timed for the interval defined by the value of DSP_SWTCH_ON_CMPLT. When that happens, switch 244 switches to indicate the value of the parameter DSP_ICP_SWTCH as "2", informing the ICP control strategy that the process of selecting stage 42B has now been completed.

As clock 238 is timing, a function 248 (FN_DSP_SWTCH_ON) utilizes the elapsed time to create a multiplier that is utilized by a multiplication function 250. The multiplier increases as a function of time from an initial value of zero to a final value of unity. At each iteration of the strategy, multiplication function 250 multiplies ICP_STG2_FF_DTY by the current value of the multiplier. The resulting product is a value for DSP_STG2_DTY.

As clock 240 is timing, a function 252 (FN_DSP_SWTCH_OFF) utilizes the elapsed time to create a multiplier that is utilized by a multiplication function 254. The multiplier decreases as a function of time from an initial value of unity to a final value of zero. At each iteration of the strategy, multiplication function 254 multiplies ICP_STG1_FF_DTY by the current value of the multiplier. The resulting product is a value that is summed by a summing function 256 with a value that is furnished by another multiplication function 258 to create a data value for DSP_STG1_DTY.

The value furnished by multiplication function 258 results from multiplication of two data values one of which is unity and the other of which is the difference between unity and the multiplier furnished by multiplication function 254. That difference is furnished by a difference function 260 that takes the difference between the multiplier furnished by function 252 and unity.

At each iteration of processing, elapsed running time on clock 240 is compared with a data value of a parameter DSP_SWTCH_OFF_CMPLT by a comparison function 262. DSP_SWTCH_OFF_CMPLT defines the time interval allotted for completing the transition for stage 42A so that DSP_STG1_DTY has a value indicating maximum duty cycle for the signal being applied to valve 52. When function 262 detects that elapsed clock time has exceeded the time allotted by DSP_SWTCH_OFF_CMPLT, a signal is given to an AND function 264. Another signal is given to AND function 264 when function 242 detects that elapsed clock time has exceeded the time allotted by DSP_SWTCH_ON_CMPLT. When AND function 264 detects that both allotted time intervals have elapsed, the value of DSP_LTCH_RST changes to cause latch function 162 to be reset. Values for DSP_LTCH_RST, DSP_STG1_DTY, DSP_STG2_DTY, and DSP_ICP_SWTCH are processed through a multiplex function 266 before passing through switch 182 to demultiplex function 184.

The processing strategy for path 170 switches from selecting only pump stage 42B to selecting both pump stages 42A, 42B. The path strategy must also satisfy the premise that at the conclusion of the switching transition, the maximum duty cycle will be applied to close valve 52 so that stage 42A will then be pumping 100% of its output to oil rail 44.

Figure 11:
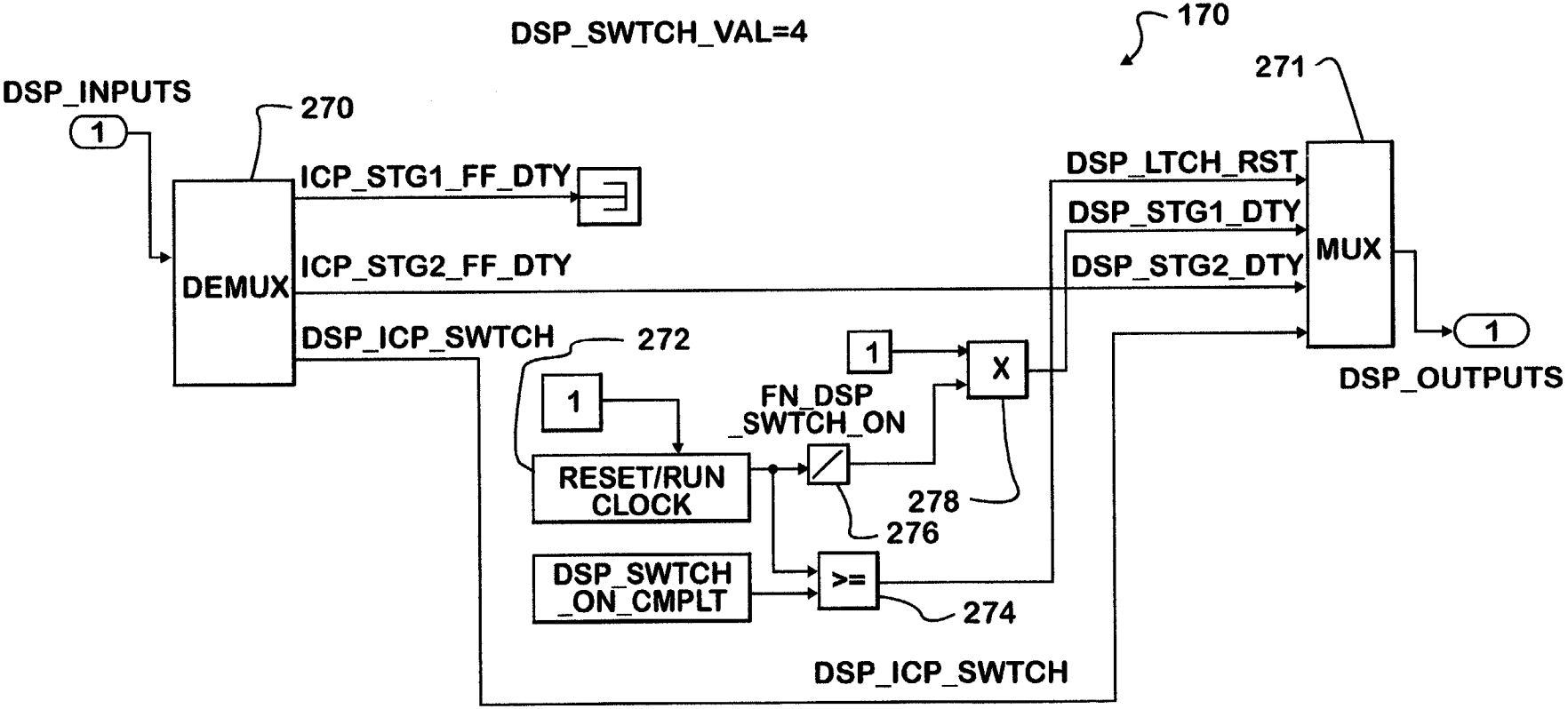

The strategy is shown in FIG. 11 to comprise a demultiplex function 270 that demultiplexes the data provided by multiplex function 180 to enable processing of the data values for ICP_STG1_FF_DTY and ICP_STG2_FF_DTY to accomplish a gradual switching transition.

Upon path 170 being enabled, the value "2" of DSP_ICP_SWTCH is immediately and continually passed to a multiplexer 271, as is the value of ICP_STG2_FF_DTY so that the value of DSP_STG2_DTY is identical to that of ICP_STG2_FF_DTY. A clock 272 is also started upon path 170 being enabled. At each iteration of processing, elapsed running time on the clock is compared with a data value of a parameter DSP_SWTCH_ON_CMPLT by a comparison function 274. DSP_SWTCH_ON_CMPLT defines the time interval allotted for completing the transition selecting stage 42A. Upon elapse of that time interval, the reset signal DSP_LTCH_RST is given, resetting latch function 162.

As clock 272 is timing, a function 276 (FN_DSP_SWTCH_ON) utilizes the elapsed time to create a multiplier that is utilized by a multiplication function 278. The multiplier increases as a function of time from an initial value of zero to a final value of unity. At each iteration of the strategy, multiplication function 278 multiplies the current value of the multiplier by unity so that at the completion of the switching transition, DSP_STG1_DTY will have a value causing the maximum duty cycle to be applied to close valve 52 so that stage 42A will then be pumping 100% of its output to oil rail 44.

The processing strategy for path 172 switches from selecting both pump stages 42A, 42B to selecting only stage 42A.

Figure 12:
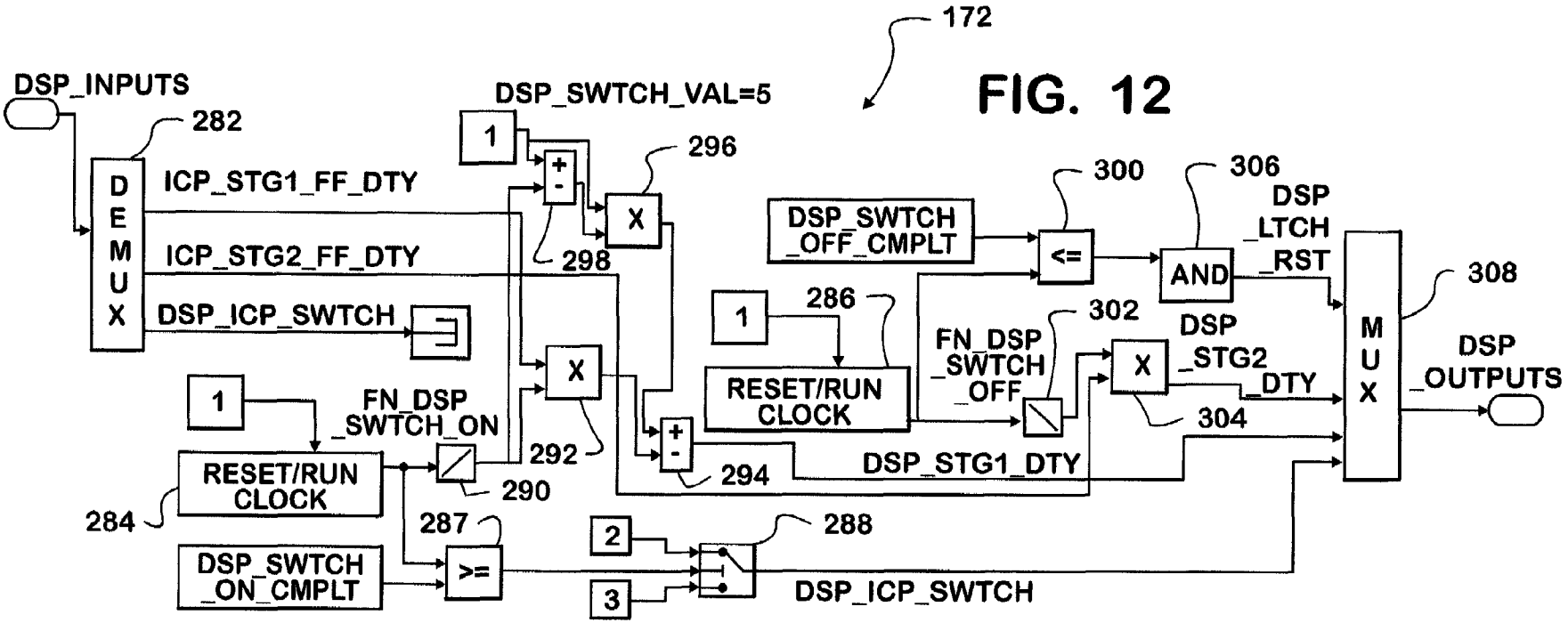

The strategy is shown in FIG. 12 to comprise a demultiplex function 282 that demultiplexes the data provided by multiplex function 180 to enable processing of the data values for ICP_STG1_FF_DTY and ICP_STG2_FF_DTY to accomplish a gradual switching transition.

Upon path 172 being enabled, two clocks 284, 286 are started. At each iteration of processing, elapsed running time on clock 284 is compared with a data value of a parameter DSP_SWTCH_ON_CMPLT by a comparison function 287. DSP_SWTCH_ON_CMPLT defines the time interval allotted for completing the switching that will result in only stage 42A being selected. Initially a switch 288 is indicating the value of the parameter DSP_ICP_SWTCH as "3", informing the ICP control strategy that the pump stage selection is in the process of changing. Switch 288 continues to indicate that state until clock 284 has timed for the interval defined by the value of DSP_SWTCH_ON_CMPLT. When that happens, switch 288 switches to indicate the value of the parameter DSP_ICP_SWTCH as "1", informing the ICP control strategy that the process of selecting stage 42A has been completed.

As clock 284 is timing, a function 290 (FN_DSP_SWTCH_ON) utilizes the elapsed time to create a multiplier that is utilized by a multiplication function 292. The multiplier increases as a function of time from an initial value of zero to a final value of unity. At each iteration of the strategy, multiplication function 292 multiplies ICP_STG1_FF_DTY by the current value of the multiplier. The resulting product is a value that is summed by a summing function 294 with a value that is furnished by another multiplication function 296 to create a data value for DSP_STG1_DTY. This processing causes the value of DSP_STG1_DTY to decrease from unity to a value defined by ICP_STG1_FF_DTY.

The value furnished by multiplication function 296 results from multiplication of two data values one of which is unity and the other of which is the difference between unity and the multiplier furnished by function 290. That difference is furnished by a difference function 298 that takes the difference between the multiplier furnished by function 290 and unity.

At each iteration of processing, elapsed running time on clock 286 is compared with a data value of a parameter DSP_SWTCH_OFF_CMPLT by a comparison function 300. DSP_SWTCH_OFF_CMPLT defines the time interval allotted for completing the transition for de-selecting stage 42B. During the de-selection process, a function 302 (FN_DSP_SWTCH_OFF) utilizes the elapsed time to create a multiplier that is utilized by a multiplication function 304. The multiplier decreases as a function of time from an initial value of unity to a final value of zero. At each iteration of the strategy, multiplication function 304 multiplies ICP_STG2_FF_DTY by the current value of the multiplier to develop a data value for DSP_STG2_DTY which progressively decreases to one representing zero duty cycle so that at the completion of the de-selection process, valve 54 will be maximally open to shunt all oil pumped by stage 42B to the sump.

When function 300 detects that elapsed clock time has exceeded the time allotted by DSP_SWTCH_OFF_CMPLT, a signal is given to an AND function 306. Another signal is given to AND function 306 when function 286 detects that elapsed clock time has exceeded the time allotted by DSP_SWTCH_ON_CMPLT. When AND function 306 detects that both allotted time intervals have elapsed, the value of DSP_LTCH_RST changes to cause latch function 162 to be reset. Values for DSP_LTCH_RST, DSP_STG1_DTY, DSP_STG2_DTY, and DSP_ICP_SWTCH are processed through a multiplex function 308 before passing through switch 182 to demultiplex function 184.

The processing strategy for path 174 switches from selecting both pump stages 42A, 42B to selecting only stage 42B.

Figure 13:
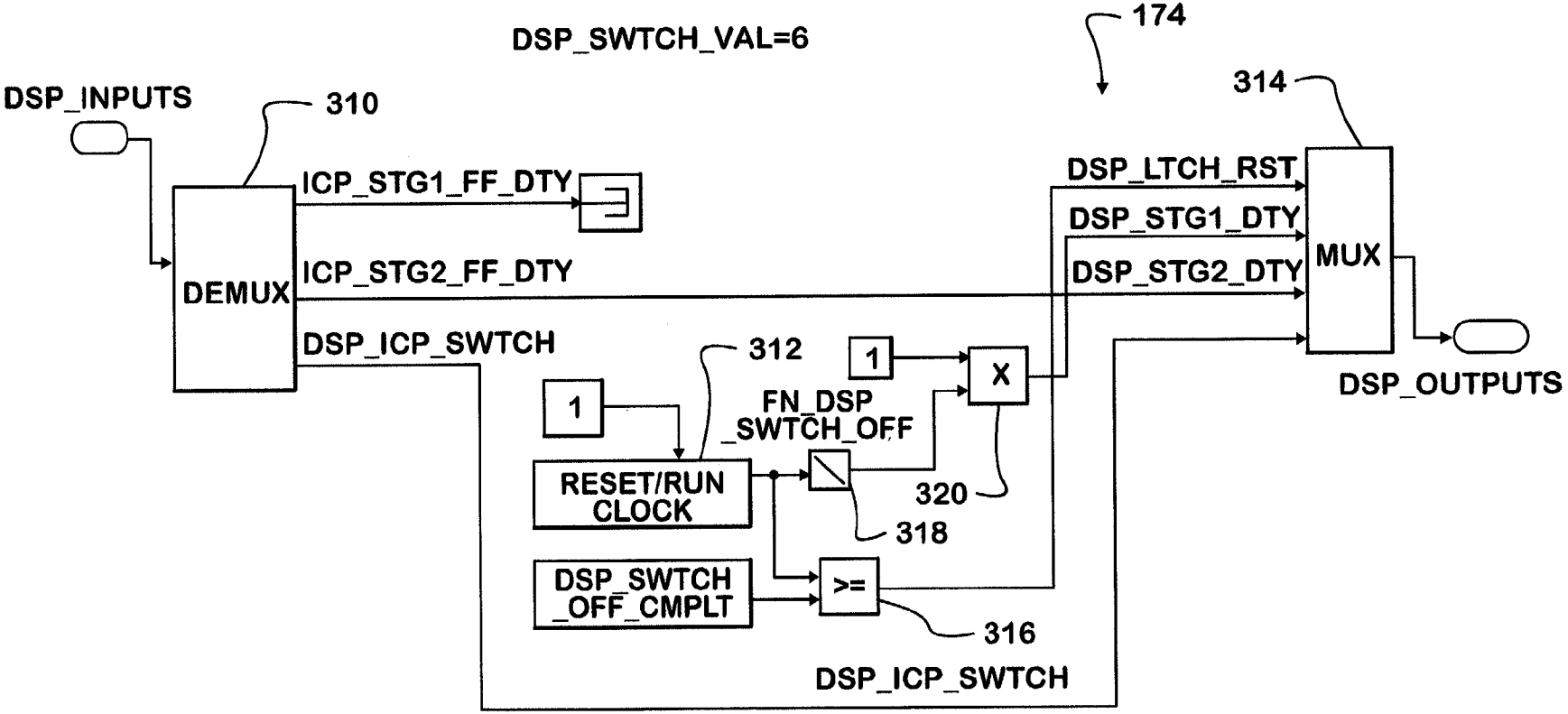

The strategy is shown in FIG. 13 to comprise a demultiplex function 310 that demultiplexes the data provided by multiplex function 180 to enable processing of the data values for ICP_STG1_FF_DTY and ICP_STG2_FF_DTY to accomplish a gradual switching transition.

Upon path 174 being enabled, the value "2" of DSP_ICP_SWTCH is immediately and continually passed to a multiplexer 314, as is the value of ICP_STG2_FF_DTY so that the value of DSP_STG2_DTY is identical to that of ICP_STG2_FF_DTY. A clock 312 is also started upon path 174 being enabled. At each iteration of processing, elapsed running time on the clock is compared with a data value of a parameter DSP_SWTCH_OFF_CMPLT by a comparison function 316. DSP_SWTCH_OFF_CMPLT defines the time interval allotted for completing the de-selection of stage 42A. Upon elapse of that time interval, the reset signal DSP_LTCH_RST is given, resetting latch function 162.

As clock 312 is timing, function 318 (FN_DSP_SWTCH_ON) utilizes the elapsed time to create a multiplier that is utilized by a multiplication function 320. The multiplier decreases as a function of time from an initial value of unity to a final value of zero. At each iteration of the strategy, multiplication function 320 multiplies the current value of the multiplier by unity so that at the completion of the de-selection, DSP_STG1_DTY will have a value causing valve 52 to be maximally open so that stage 42A will then be pumping 100% of its output to the sump.

Figure 14:
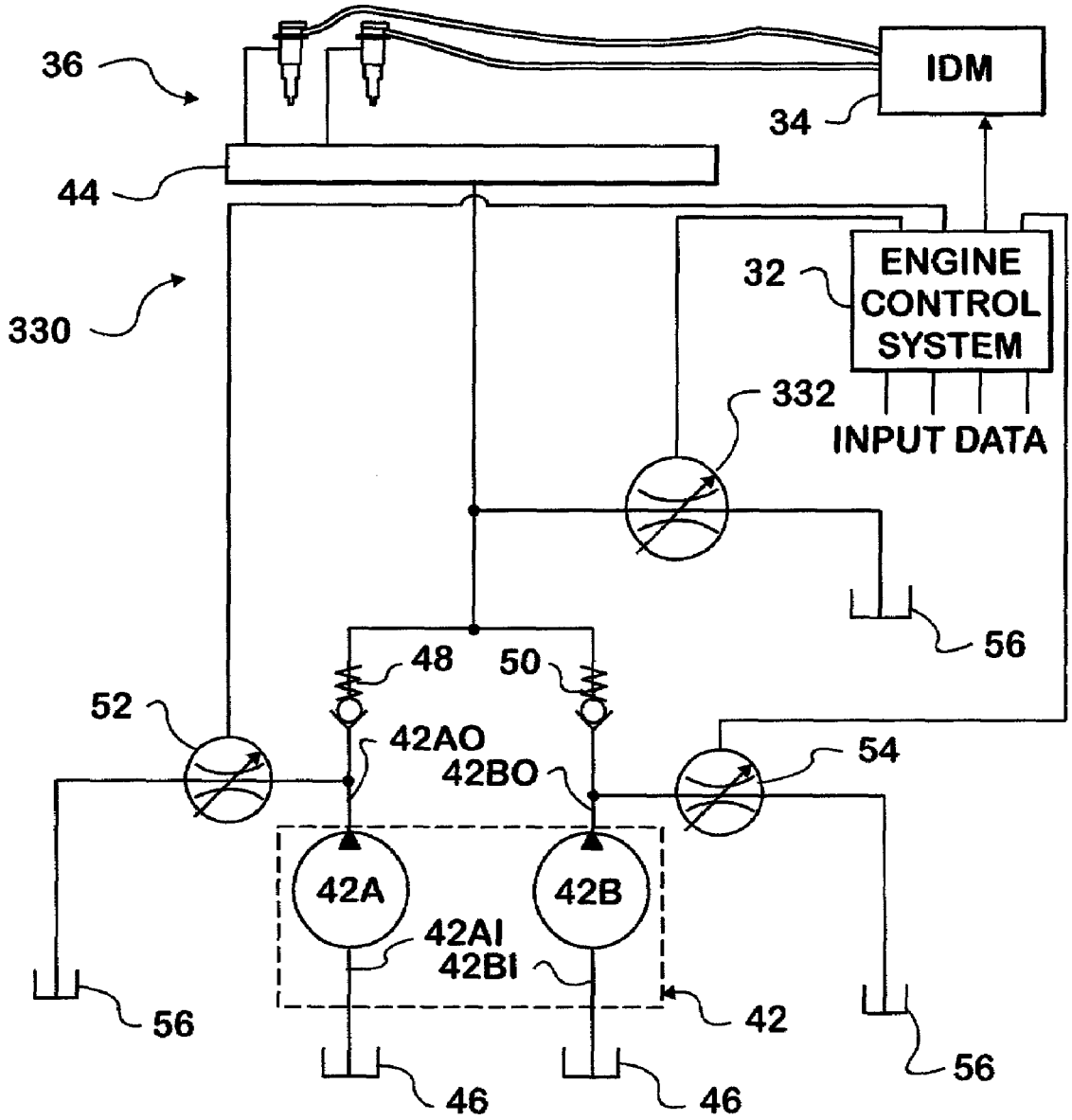
FIG. 14 is a general schematic diagram of a portion of an exemplary diesel engine relevant to an understanding of the invention having an engine oil system, including a variable displacement oil pump, controlled in accordance with a second strategy embodying principles of the present invention.

The second embodiment 330 of FIG. 14 is similar to the first embodiment 30 of FIG. 1, and corresponding elements are identified by the same reference numerals in both Figures. FIG. 14 differs in that a third flow control valve 332 is employed to shunt oil to sump 56 from the common outlet of the two check valves 48, 50. The strategy comprises selecting either one or both stages on the premise that when a stage is selected, the respective flow control valve 52, 54 will be operated closed so that all of the oil pumped by a selected stage will be delivered to oil rail 44. The extent to which flow control valve 332 is allowed to open sets the amount of pumped oil that is shunted from rail 44 to sump 56 so that as a result, it is valve 332 that controls ICP.

Figure 18:
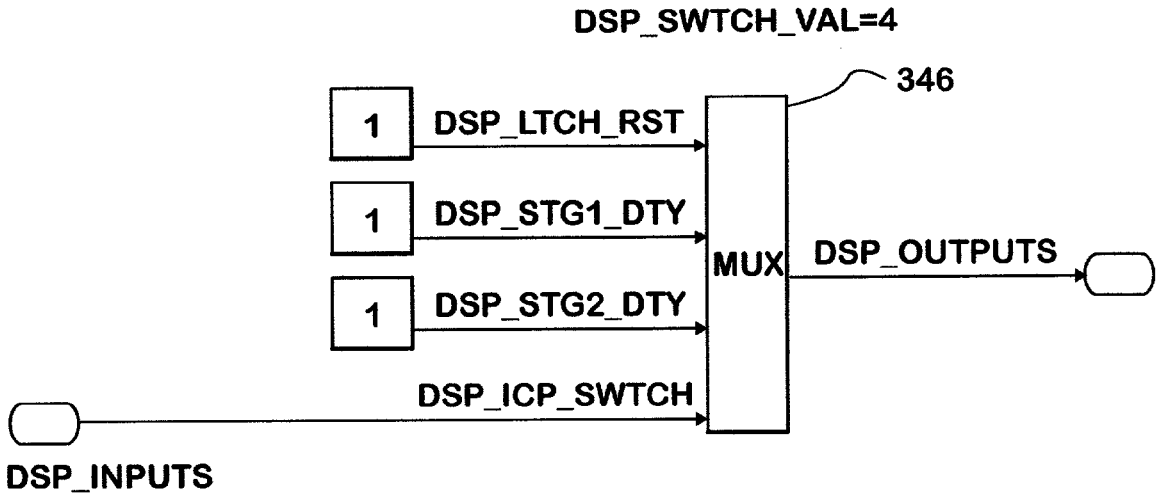
FIGS. 18–20 are schematic software strategy diagrams showing more detail of certain respective portions of the second strategy.
Figure 19:
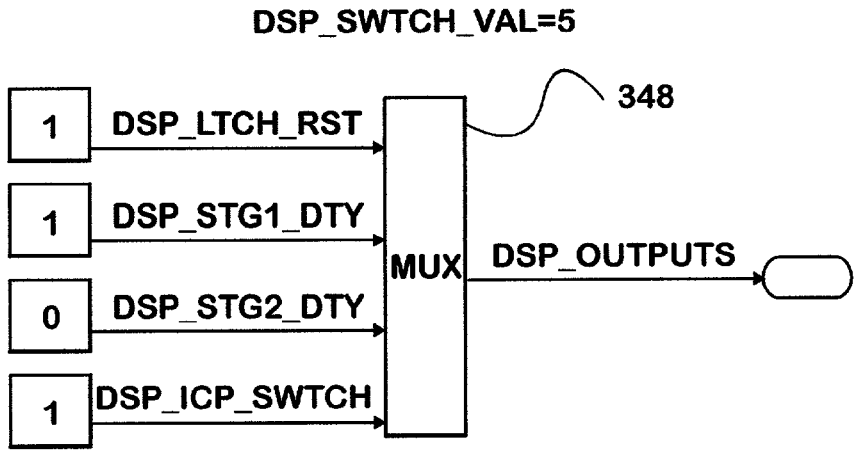
Figure 20:
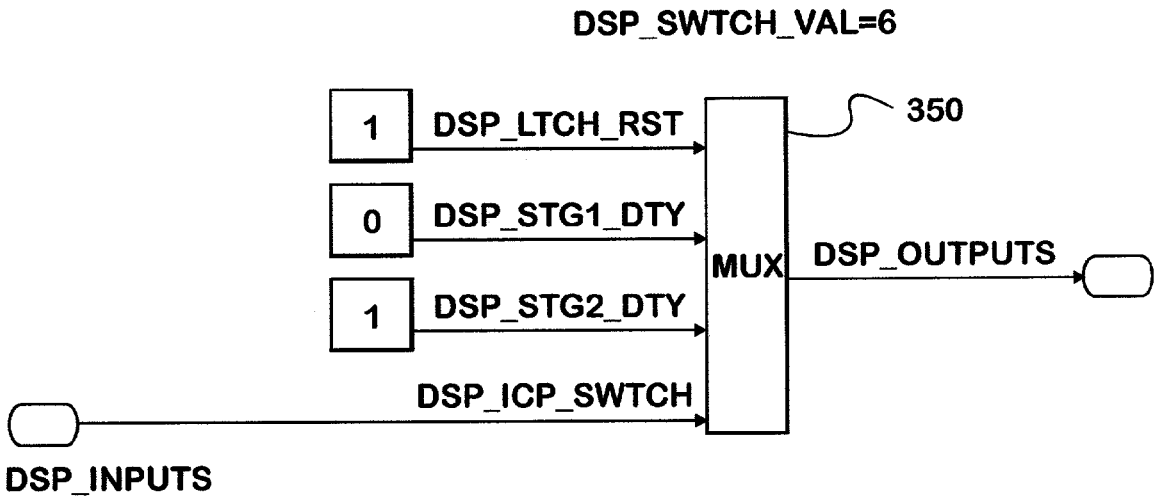

The strategy diagrams of FIGS. 2-7 are applicable to that of the second embodiment, but the second embodiment differs on that FIGS. 18–20, instead of FIGS. 8–13, apply. A data value of "1" for DSP_SWTCH_VAL calls for de-selecting pump stage 42A and selecting stage 42B. A data value of "2" for DSP_SWTCH_VAL calls for de-selecting pump stage 42B and selecting stage 42A. A data value of "3" for DSP_SWTCH_VAL calls for selecting pump stage 42B while continuing the prior selection of stage 42A. A data value of "4" for DSP_SWTCH_VAL calls for selecting pump stage 42A while continuing the prior selection of stage 42B. A data value of "5" for DSP_SWTCH_VAL calls for de-selecting pump stage 42B while continuing the selection of stage 42A. A data value of "6" for DSP_SWTCH_VAL calls for de-selecting pump stage 42A while continuing the selection of stage 42B. ICP_STG1_FF_DTY and ICP_STG2_FF_DTY are not used in the switching strategy for the three-valve configuration.

Figure 15:
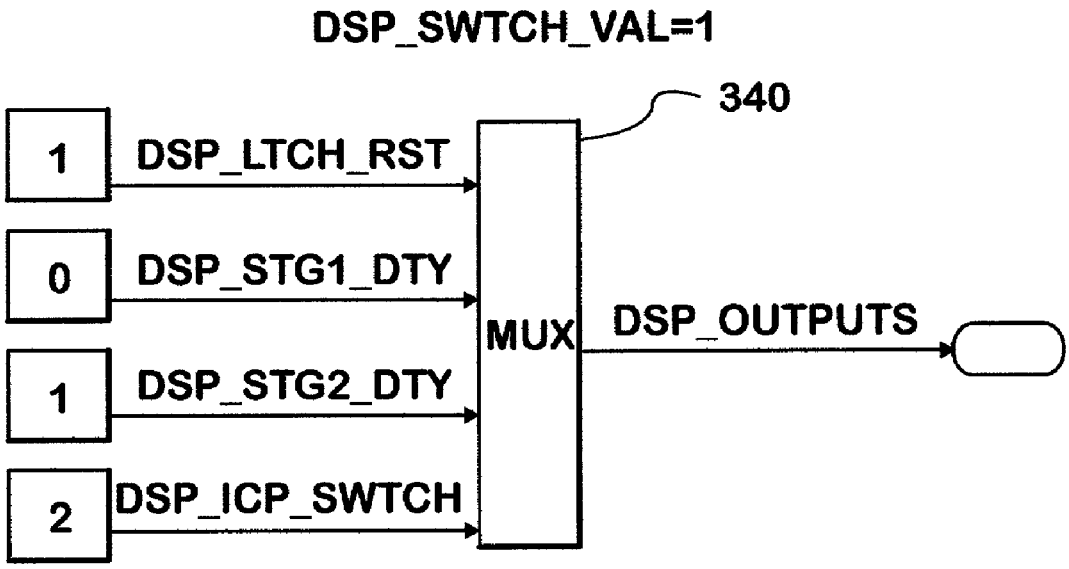

FIG. 15 depicts the strategy that is executed upon DSP_SWTCH_VAL assuming a value of "1". The data values for DSP_STG1_DTY and DSP_STG2_DTY that are processed by a multiplex function 340 to provide corresponding DSP outputs are set to zero and unity respectively immediately upon the value of DSP_SWTCH_VAL becoming "1". This causes maximum duty cycle to be immediately applied to valve 54, causing stage 42B to pump all of its oil through check valve 50 while valve 52 is operated maximally open to shunt all of the oil from stage 42A to sump 56. Latch 162 is immediately reset, and DSP_ICP_SWTCH is set to a value of "2" which is then given to the ICP strategy. The ICP strategy controls valve 332 to provide desired ICP.

Figure 16:
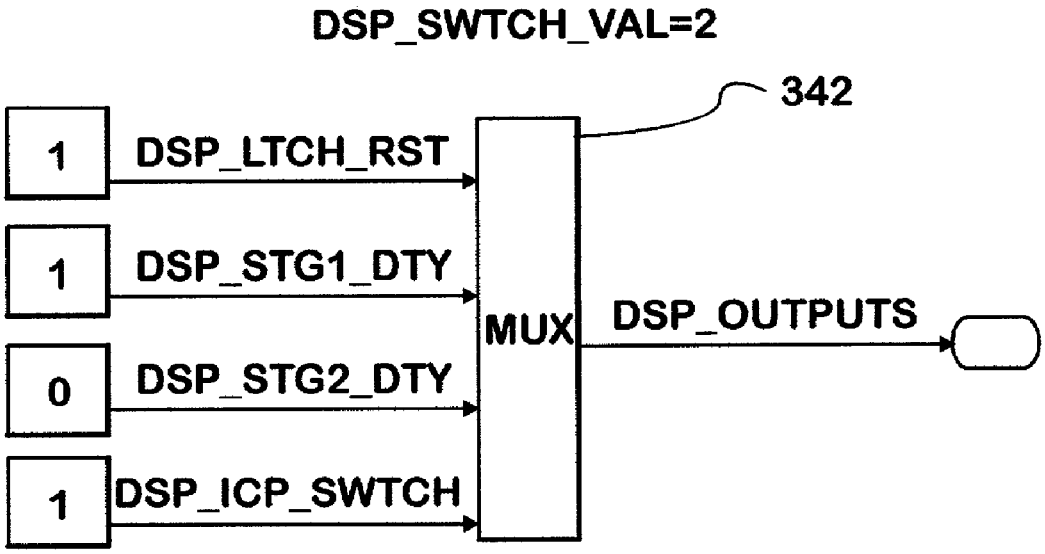

FIG. 16 depicts the strategy that is executed upon DSP_SWTCH_VAL assuming a value of "2". The data values for DSP_STG1_DTY and DSP_STG2_DTY that are processed by a multiplex function 342 to provide corresponding DSP outputs are set to unity and zero respectively immediately upon the value of DSP_SWTCH_VAL becoming "2". This causes maximum duty cycle to be immediately applied to valve 52, causing stage 42A to pump all of its oil through check valve 48 while valve 54 is operated maximally open to shunt all of the oil from stage 42B to sump 56. Latch 162 is immediately reset, and DSP_ICP_SWTCH is set to a value of "1" which is given to the ICP strategy. The ICP strategy controls valve 332 to provide desired ICP.

Figure 17:
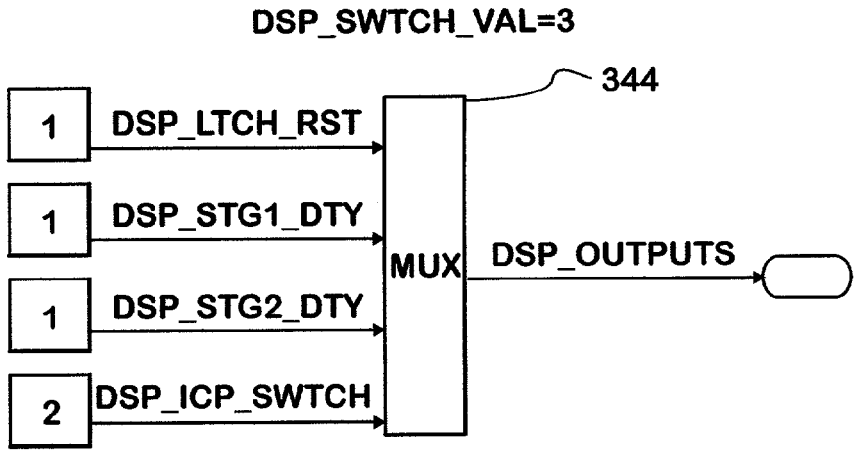

FIG. 17 depicts the strategy that is executed upon DSP_SWTCH_VAL assuming a value of "3". The data values for DSP_STG1_DTY and DSP_STG2_DTY that are processed by a multiplex function 344 to provide corresponding DSP outputs are both set to unity immediately upon the value of DSP_SWTCH_VAL becoming "3". This causes maximum duty cycle to be applied to both valves 52, 54, causing both stages 42A, 42B to pump all of their oil through check valves 48, 50. Latch 162 is immediately reset, and DSP_ICP_SWTCH is set to a value of "2" which is given to the ICP strategy. The ICP strategy controls valve 332 to provide desired ICP.

FIG. 18 depicts the strategy that is executed upon DSP_SWTCH_VAL assuming a value of "4". The data values for DSP_STG1_DTY and DSP_STG2_DTY that are processed by a multiplex function 346 to provide corresponding DSP outputs are both set to unity immediately upon the value of DSP_SWTCH_VAL becoming "4". This causes maximum duty cycle to be applied to both valves 52, 54, causing both stages 42A, 42B to pump all of their oil through check valves 48, 50. Latch 162 is immediately reset, and DSP_ICP_SWTCH is set to a value of "2" which is given to the ICP strategy. The ICP strategy controls valve 332 to provide desired ICP.

FIG. 19 depicts the strategy that is executed upon DSP_SWTCH_VAL assuming a value of "5". The data values for DSP_STG1_DTY and DSP_STG2_DTY that are processed by a multiplex function 348 to provide corresponding DSP outputs are set to unity and zero respectively immediately upon the value of DSP_SWTCH_VAL becoming "5". This causes maximum duty cycle to be applied only to valve 52, causing stage 42A to pump all of its oil through check valve 48, while valve 54 is operated maximally open. Latch 162 is immediately reset, and DSP_ICP_SWTCH is set to a value of "1" which is given to the ICP strategy. The ICP strategy controls valve 332 to provide desired ICP.

FIG. 20 depicts the strategy that is executed upon DSP_SWTCH_VAL assuming a value of "6". The data values for DSP_STG1_DTY and DSP_STG2_DTY that are processed by a multiplex function 350 to provide corresponding DSP outputs are set to zero and unity respectively immediately upon the value of DSP_SWTCH_VAL becoming "6". This causes maximum duty cycle to be applied only to valve 54, causing stage 42B to pump all of its oil through check valve 50, while valve 52 is operated maximally open. Latch 162 is immediately reset, and DSP_ICP_SWTCH is set to a value of "2" which is given to the ICP strategy. The ICP strategy controls valve 332 to provide desired ICP.

While a presently preferred embodiment of the invention has been illustrated and described, it should be appreciated that principles of the invention apply to all embodiments falling within the scope of the following claims.

What is claimed is:

1. An internal combustion engine comprising:

a fueling system comprising fuel injectors that utilize pumped hydraulic fluid to force fuel into engine combustion chambers;

a hydraulic system comprising an engine-driven multi-stage pump, whose effective displacement can be varied by selecting and de-selecting the stages, for pumping hydraulic fluid to the fuel injectors;

a control system for controlling the effective displacement of the pump to thereby control the flow of pumped fluid to the fuel injectors, wherein the flow of pumped fluid merges into a common fluid flow toward the fuel injectors; and a further valve hydraulically connected to shunt the common fluid flow away from the fuel injectors.

2. An internal combustion engine as set forth in claim 1 wherein each stage is of fixed displacement, and further comprises valves associated with the stages and operated by the control system for selecting and de-selecting the stages.

3. An internal combustion engine as set forth in claim 2 wherein the control system selects and de-selects the stages according to the processing of values of certain engine operating parameters by a processor of the control system.

4. An internal combustion engine as set forth in claim 3 wherein the control system is operable to, at times, select a single stage to the exclusion of other stages according to the processing of the values of certain engine operating parameters at those times.

5. An internal combustion engine as set forth in claim 4 wherein the control system comprises an injection control pressure strategy for controlling pressure of hydraulic fluid used by the fuel injectors to force fuel into the engine, and the injection control pressure strategy controls a valve associated with the selected single stage to control the pressure of hydraulic fluid used by the fuel injectors.

6. An internal combustion engine as set forth in claim 5 wherein the valve associated with the selected single stage is hydraulically connected with that stage to shunt pumped hydraulic fluid from that stage to an extent determined by the injection control pressure strategy.

7. An internal combustion engine as set forth in claim 3 wherein the control system is operable to, at times, select multiple stages according to the processing of the values of certain engine operating parameters at those times.

8. An internal combustion engine as set forth in claim 7 wherein a respective valve is associated with a respective stage, and when the control system is selecting multiple stages, the valves are operated such that all of the fluid being pumped by one of the selected stages is being delivered to the fuel injectors.

9. An internal combustion engine as set forth in claim 8 wherein the control system comprises an injection control pressure strategy for controlling pressure of hydraulic fluid used by the fuel injectors to force fuel into the engine, and the injection control pressure strategy controls a valve associated with another of the selected stages to control the pressure of hydraulic fluid used by the fuel injectors.

10. An internal combustion engine as set forth in claim 9 wherein each valve is hydraulically connected with the respective stage to shunt pumped hydraulic fluid from that stage to a sump, and when the valve associated with the one selected stage is shunting none of the fluid being pumped by that one stage, the valve associated with the another selected stage is shunting fluid being pumped by the another selected stage to an extent determined by the injection control pressure strategy.

11. An internal combustion engine as set forth in claim 2 wherein the control system selects and de-selects the stages according to the processing of values of engine operating parameters that include one or more of engine speed, engine load, and engine operating temperature.

12. An internal combustion engine as set forth in claim 2 wherein the control system selects and de-selects the stages according to the processing of values that distinguish between engine cranking and engine running.

13. An internal combustion engine as set forth in claim 1 wherein the control system comprises a processor that processes values of engine operating parameters that include one or more of engine speed, engine load, and engine operating temperature and values that distinguish between engine cranking and engine running, and that uses a result of the processing to control effective displacement of the pump.

14. An internal combustion engine as set forth in claim 2 wherein the further valve shunts the common fluid flow away from the fuel injectors to an extent determined by the control system for achieving a desired hydraulic pressure of the fluid at the fuel injectors.

15. An internal combustion engine comprising:

a fueling system comprising fuel injectors that utilize pumped hydraulic fluid to force fuel Into engine combustion chambers;

a hydraulic system comprising a multi-stage pump for pumping hydraulic fluid to the fuel injectors, wherein fluid flow from each of the stages is merged into a common fluid flow;

a control system for selecting and de-selecting the pump stages for pumping fluid to the fuel injectors;

at least one valve controlled by the control system that shunts pumped hydraulic fluid; and a further valve to shunt the common fluid flaw away torn the fuel injectors.

16. An internal combustion engine as set forth in claim 15 wherein the at least one valve is associated with at least one stage and operated by the control system for selecting and de-selecting the at least one stage.

17. An internal combustion engine as set forth in claim 15 wherein the control system is operable to, at times, select a single stage to the exclusion of other stages according to the processing of the values of certain engine operating parameters at those times, and at other times, select multiple stages according to the processing of the values of certain engine operating parameters at those other times.

18. An internal combustion engine as set forth in claim 15 in which the pump is driven by the engine, and each pump stage has a fixed displacement.

19. A method for use in control of a fueling system of an internal combustion engine that has fuel injectors that utilize pumped hydraulic fluid to force fuel into engine combustion chambers and a hydraulic system comprising an engine-driven pump for pumping the hydraulic fluid to the fuel injectors, the method comprising the step of:

varying the effective displacement of the pump to thereby control the flow of pumped fluid to the fuel injectors by selecting and de-selecting stages of the pump;

merging the fluid flows from the stages of the pump into a common fluid flow toward the fluid injectors; and operating a further valve to shunt the common fluid flow away from the fuel injectors.

20. A method as set forth in claim 19 wherein the stages of the pump have a fixed displacement.

21. A method as set forth in claim 20 wherein the step of selecting and de-selecting the fixed displacement stages comprises processing values of certain engine operating parameters by a processor and using a result of the processing to select and de-select the stages.

22. A method as set forth in claim 21 wherein the step of varying the effective displacement of the pump comprises, at times, selecting a single stage to the exclusion of other stages according to the processing of the values of certain engine operating parameters at those times.

23. A method as set forth in claim 22 including the step of executing an injection control pressure strategy for controlling pressure of hydraulic fluid used by the fuel injectors to force fuel into the engine, wherein the executing step operates a valve associated with the selected single stage to control the pressure of hydraulic fluid used by the fuel injectors.

24. A method as set forth in claim 23 wherein the valve associated with the selected single stage is operated to shunt pumped hydraulic fluid from that stage to an extent determined by execution of the injection control pressure strategy.

25. A method as set forth in claim 21 wherein the step of varying the effective displacement of the pump comprises, at times, selecting multiple stages according to the processing of the values of certain engine operating parameters at those times.

26. A method as set forth in claim 25 wherein the step of selecting multiple stages comprises operating a valve associated with one selected stage such that all of the fluid being pumped by that one selected stage is delivered to the fuel injectors.

27. A method as set forth in claim 26 including the steps of executing an injection control pressure strategy for controlling pressure of hydraulic fluid used by the fuel injectors to force fuel into the engine, and using a result of the executing step to control a valve associated with another of the selected stages and consequently the pressure of hydraulic fluid used by the fuel injectors.

28. A method as set forth in claim 27 including the steps of operating the valve associated with the one selected stage so that none of the fluid being pumped by that one stage is shunted from the fuel injectors, and operating the valve associated with the another selected stage to shunt fluid being pumped by the another selected stage to an extent determined by the injection control pressure strategy.

29. A method as set forth in claim 20 wherein the step of selecting and de-selecting the stages comprises processing values of engine operating parameters that include one or more of engine speed, engine load, and engine operating temperature and using a result of the processing to select and de-select the stages.

30. A method as set forth in claim 20 wherein the step of selecting and de-selecting the stages comprises processing values that distinguish between engine cranking and engine running.

31. A method as set forth in claim 19 including the steps of processing values of engine operating parameters that include one or more of engine speed, engine load, and engine operating temperature and values that distinguish between engine cranking and engine running, and using a result of the processing for varying effective displacement of the pump.

32. A method as set forth in claim 20 wherein the further valve is operated to an extent that achieves a desired hydraulic pressure of the fluid at the fuel injectors.

33. A method for use in control of a fueling system of an internal combustion engine that has fuel injectors that utilize pumped hydraulic fluid to force fuel into engine combustion chambers and a hydraulic system comprising a multi-stage pump for pumping the hydraulic fluid to the fuel injectors, the method comprising:

selecting and de-selecting the pump stages for pumping fluid to the fuel;

merging pumped hydraulic fluid from the multi-stage pump into common fluid flow; and shunting the common fluid flow away from the fuel injectors.

34. A method as set forth in claim 33 wherein the step of selecting and de-selecting the pump stages comprises operating a respective valve that is associated with each stage to select and de-select the respective stage.

35. A method as set forth in claim 33 wherein the step of selecting and de-selecting the pump stages comprises, at times, selecting a single stage to the exclusion of other stages according to the processing of the values of certain engine operating parameters at those times, and at other times, selecting multiple stages according to the processing of the values of certain engine operating parameters at those other times.

36. A method as set forth in claim 33 including the step of shunting pumped fluid away from the fuel injectors.

* * * * *